US011661693B2

(12) United States Patent
Shiratsuchi

(10) Patent No.: US 11,661,693 B2
(45) Date of Patent: May 30, 2023

(54) EMBROIDERY APPARATUS

(71) Applicant: JANOME SEWING MACHINE CO., LTD., Hachioji (JP)

(72) Inventor: Hiroki Shiratsuchi, Hachioji (JP)

(73) Assignee: JANOME CORPORATION, Tokyo (JP)

( * ) Notice: Subject to any disclaimer, the term of this patent is extended or adjusted under 35 U.S.C. 154(b) by 11 days.

(21) Appl. No.: 17/308,359

(22) Filed: May 5, 2021

(65) Prior Publication Data

US 2021/0388551 A1 Dec. 16, 2021

(30) Foreign Application Priority Data

Jun. 11, 2020 (JP) ..... JP2020-101641

(51) Int. Cl.
*D05C 9/06* (2006.01)

(52) U.S. Cl.
CPC ..... *D05C 9/06* (2013.01)

(58) Field of Classification Search
CPC ..... D04B 39/00; D04B 39/005; D04B 21/00; D04C 9/04; D04C 9/06; D05B 39/00; D05B 39/005; D05B 21/00; D05C 9/04; D05C 9/06
See application file for complete search history.

(56) References Cited

U.S. PATENT DOCUMENTS 5,040,476 A * 8/1991 Takenoya ..... D05B 19/12 112/168
5,284,104 A * 2/1994 Hori ..... D05B 19/12 112/102.5
5,666,894 A * 9/1997 Jonsson ..... D05B 3/243 112/103
6,158,365 A * 12/2000 Hidechika ..... D05B 21/00 112/103
6,293,212 B1 * 9/2001 Ebata ..... D05B 21/00 112/168
8,051,787 B2 * 11/2011 Hidechika ..... D05B 69/30 112/102.5

(Continued)

FOREIGN PATENT DOCUMENTS

JP 2001-104672 A 4/2001
JP 2007-135663 A 6/2007
JP 4330728 B2 * 9/2009 ..... D05B 21/00

*Primary Examiner* — Danny Worrell
(74) *Attorney, Agent, or Firm* — WHDA, LLP

(57) ABSTRACT

An embroidery apparatus includes a main unit to be detachably mounted on a bed section of a sewing machine, a first translation mechanism that moves an embroidery frame holder with an embroidery frame mounted thereon in a first direction, a second translation mechanism that moves the first translation mechanism along an upper surface of the main unit in a second direction that orthogonally intersects the first direction, and an elevator mechanism that is supported by the second translation mechanism at opposite sides of the main unit and that raises and lowers the first translation mechanism. The embroidery apparatus is applicable to a sewing machine switchable between embroidery stitching and standard stitching. During standard stitching, the upper surface of the first translation mechanism is flush with the upper surface of the main unit, which enables both upper surfaces to be used as an auxiliary table.

10 Claims, 15 Drawing Sheets

(56) References Cited

U.S. PATENT DOCUMENTS

| | | | | |
|---|---|---|---|---|
| 2007/0119354 | A1* | 5/2007 | Ukai | D05B 21/00 112/78 |
| 2007/0204779 | A1* | 9/2007 | Naka | D05B 21/00 112/470.04 |
| 2012/0060732 | A1* | 3/2012 | Viltrakis | D05C 9/04 112/103 |
| 2018/0320301 | A1* | 11/2018 | Kawaguchi | D05C 9/04 |
| 2022/0098775 | A1* | 3/2022 | Osamura | D05C 9/04 |

* cited by examiner

EMBROIDERY APPARATUS

BACKGROUND OF INVENTION

1. Field of the Invention

The present invention relates to an embroidery apparatus to be mounted on a sewing machine that is switchable between embroidery stitching and standard stitching, and more specifically, relates to an embroidery apparatus in which a carriage unit (Y-direction translation mechanism) with an embroidery frame mounted thereon can be evacuated during standard stitching.

2. Description of the Related Art

A sewing machine accompanied by an embroidery apparatus is known. This type of the sewing machine is capable of both standard and embroidery stitching and is configured such that an embroidery frame is detachably mounted on the sewing machine to enable embroidery stitching of various patterns. In the case of performing standard stitching using the embroidery apparatus mounted on the sewing machine that is switchable between standard stitching and embroidery stitching, it is sometimes necessary to detach the embroidery apparatus from the sewing machine or detach a carriage unit with the embroidery frame mounted thereon from the embroidery apparatus.

A known embroidery apparatus (see Japanese Patent No. 4330728), which is used with a sewing machine switchable between embroidery stitching and standard stitching, has a carriage A that is disposed on a work bed 2 during embroidery stitching and that moves an embroidery frame 19 in the X and Y directions. The carriage A is driven by a carriage driving unit B accommodated in the work bed 2. In standard stitching, the carriage A is slid to an end side of the work bed 2 and is laid down there for storage.

Another known embroidery apparatus (see Japanese Unexamined Patent Application Publication No. 2007-135663) includes a Y-direction drive mechanism 34 that has a carriage 52 on which an embroidery frame 28 is detachably mounted and that moves the carriage 52 in the Y direction that orthogonally intersects the X direction. The embroidery apparatus also includes a first switching mechanism 61 that switches the Y-direction drive mechanism 34 between a stitching position where the horizontally positioned Y-direction drive mechanism 34 is enabled to perform embroidery stitching near the upper surface of a main unit 31 and a standing position where the Y-direction drive mechanism 34 stands vertically. The embroidery apparatus further includes a second switching mechanism 65 that switches the Y-direction drive mechanism 34 between the standing position and a storage position where the Y-direction drive mechanism 34 is laid horizontally along the front side of the main unit 31. When the Y-direction drive mechanism 34 is switched to the storage position, the upper surface of the body cover 35 of the Y-direction drive mechanism 34 is substantially flush with the upper surface of the body cover of the main unit 31.

In the embroidery apparatus described in Japanese Patent No. 4330728, slit-like throughholes 2*d* are formed in the work bed 2, and carriage-laying-down arms 5*b* passes through the slit-like throughholes 2*d* to move the carriage A over the work bed 2 in the X direction. When the work bed 2 is used as an auxiliary table during standard stitching, a cloth to be stitched may enter a slit-like throughhole 2*d* and get caught therein.

In the embroidery apparatus described in Japanese Unexamined Patent Application Publication No. 2007-135663, when the stitching mode is changed from embroidery stitching to standard stitching, a Y-direction cover 33 accommodating the Y-direction drive mechanism 34 is automatically moved to a switching position. It is necessary, however, for a user to manually move the Y-direction drive mechanism 34 to the standing position or to the storage position, which takes time and is inconvenient. Moreover, a downward-pointing abutting pin 85 is fixed to a left end portion of a non-engagement plate 81, and the main unit 31 has a straight slit 31*a* that is formed in the right-left direction and through which the abutting pin 85 is movable in the right-left direction together with an engagement plate 80. Due to such an arrangement, when the main unit 31 is used as an auxiliary table during standard stitching, a cloth to be stitched may enter the straight slit 31*a* and get caught therein, as is the case for the embroidery apparatus of Japanese Patent No. 4330728.

SUMMARY OF THE INVENTION

Accordingly, it is an object to provide an embroidery apparatus that can be detachably mounted on a sewing machine switchable between embroidery stitching and standard stitching, that does not have a slit used for supporting a carriage unit on the upper surface of the main unit, and that can automatically store the carriage unit with an embroidery frame mounted thereon at a position outside the main unit during standard stitching.

According to an aspect of the invention, an embroidery apparatus includes a main unit to be detachably mounted on a bed section of a sewing machine, a first translation mechanism that moves an embroidery frame holder with an embroidery frame mounted thereon in a first direction, a second translation mechanism that moves the first translation mechanism along an upper surface of the main unit in a second direction that orthogonally intersects the first direction, and an elevator mechanism that is supported by the second translation mechanism at opposite sides of the main unit and that raises and lowers the first translation mechanism.

In the embroidery apparatus, the elevator mechanism may include a pair of hinge arms that are swingably supported by the second translation mechanism. The hinge arms are swingable so as to move closer to each other and away from each other, and the swing movement of the hinge arms raises and lowers the first translation mechanism horizontally. In addition, the first translation mechanism may have an elevator driving shaft that rotates with a rotation axis extending in the first direction, and a pair of first support seats that move in the first direction due to rotation of the elevator driving shaft. In addition, each of the hinge arms may have a first end portion pivotally supported by the second translation mechanism using a fulcrum shaft, and a second end portion pivotally connected to a corresponding one of the first support seats. Moreover, the elevator mechanism may have an elevator shaft that is rotatably supported by the second translation mechanism and configured to rotate forward and backward and thereby raise and lower the first translation mechanism. In addition, the elevator mechanism may have a drive unit that is disposed at the second translation mechanism and that rotates the elevator shaft and also may have a second support seat that supports the first translation mechanism using the elevator shaft so as to be able to raise and lower the first translation mechanism.

In the embroidery apparatus, upon receiving a storage instruction, the first translation mechanism may move the embroidery frame holder to an end of the first translation mechanism and issue a first storage-ready notification, and the second translation mechanism may move the first translation mechanism in the second direction to a position outside the main unit and issue a second storage-ready notification. In addition, upon receiving the first storage-ready notification and the second storage-ready notification, the elevator mechanism may lower the first translation mechanism until an upper surface of the first translation mechanism is flush with the upper surface of the main unit.

The embroidery apparatus configured as described above does not have a slit used for supporting the first translation mechanism on the upper surface of the main unit. This reduces the likelihood of a cloth to be stitched entering the slit when the upper surface of the main unit is used as the auxiliary table during standard stitching. In addition, when the stitching mode is switched from embroidery stitching to standard stitching, the first translation mechanism is automatically evacuated from the upper surface of the main unit and stored at a position outside the main unit. Moreover, the upper surface of the first translation mechanism is positioned so as to be flush with the upper surface of the main unit, which enables both the upper surface of the first translation mechanism and the upper surface of the main unit to be used as the auxiliary table.

DESCRIPTION OF THE PREFERRED EMBODIMENT

An embroidery apparatus according to an embodiment of the present invention will be described with reference to the drawings pertaining to examples. In the perspective view of FIG. 1, a direction extending vertically in the illustration is the up-down direction of a sewing machine. A direction extending from the upper right to the lower left in the illustration is the right-left direction or the X direction of the sewing machine. A direction extending from the lower right to the upper left in the illustration is the front-rear direction or the Y direction of the sewing machine.

First Example

Figure 1:
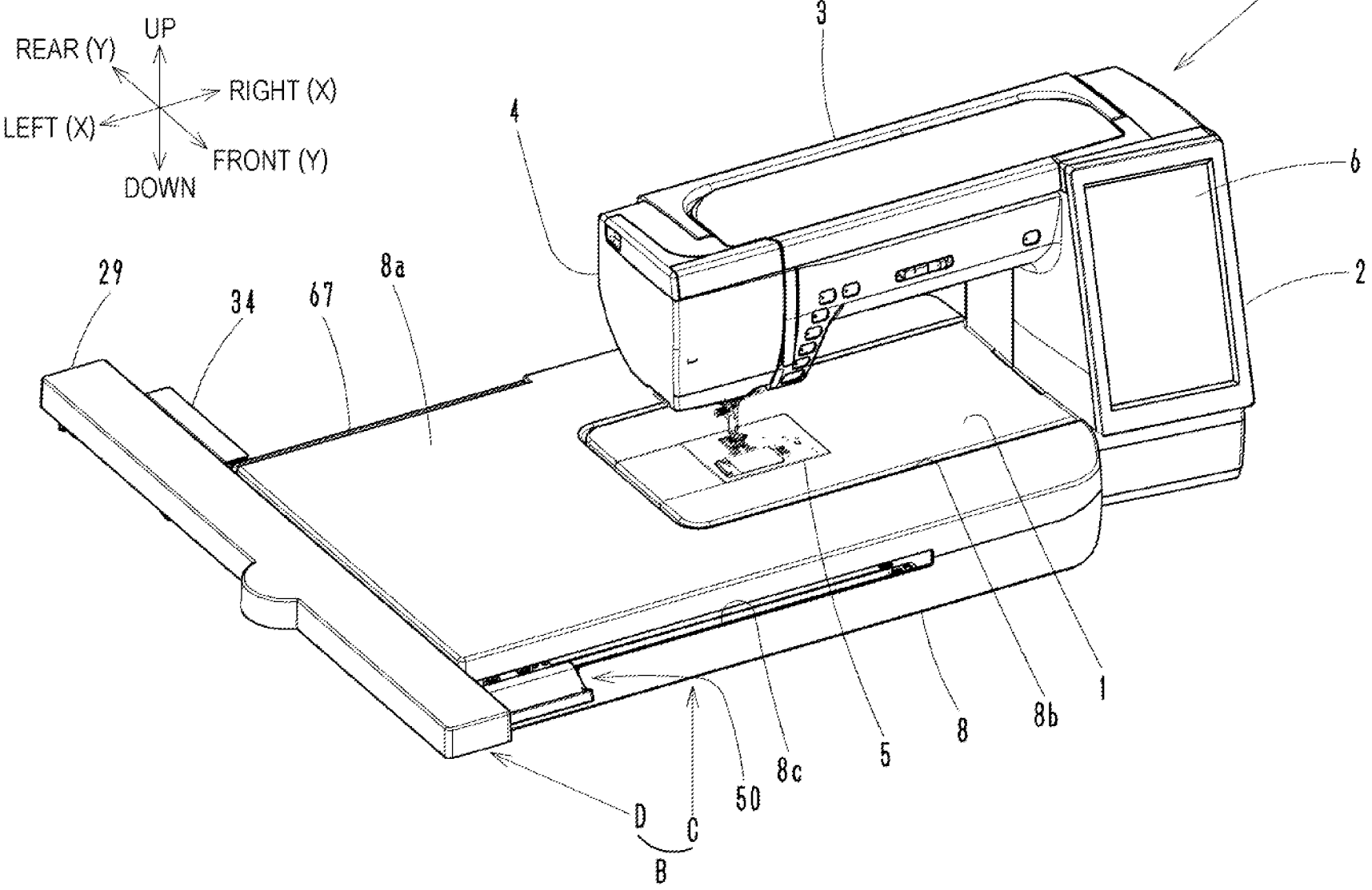
FIG. 1 is a perspective view illustrating an overall external appearance of a sewing machine on which an embroidery apparatus according to a first example of the present invention is mounted.

In FIG. 1, reference A denotes a sewing machine body. The sewing machine body A includes a bed section 1 disposed at a lower part of the sewing machine body, a column section 2 extending upward from the right end of the bed section 1, an arm section 3 extending leftward from the upper end of the column section 2 so as to oppose the bed section 1, and a head section 4 disposed at the left end of the arm section 3. Reference B denotes an embroidery apparatus that is detachably mounted onto the sewing machine body A.

The embroidery apparatus B includes a main unit C that can serve as an auxiliary table when the main unit C is mounted on the sewing machine body A. The upper surface of the main unit C is disposed so as to be flush with the bed section 1. The embroidery apparatus B also includes a carriage unit D (a first translation mechanism) that can move in the X direction (in the second direction) along the upper surface of the main unit C.

In the sewing machine body A, as illustrated in FIG. 1, a needle plate 5 through which a feed dog is intermittently raised for feeding a cloth is disposed at the upper surface of the bed section 1. A display 6 is disposed in the column section 2. The display 6 displays, for example, various selection buttons and information of a currently selected stitching pattern. A transparent touch panel that serves as a touch switch is laminated in a front portion of the display 6. A needle bar and a presser bar are disposed in the head section 4. The needle bar has a needle attached at the bottom end thereof. The needle bar moves up and down reciprocally. The presser bar has a presser foot for pressing a cloth at the upper surface of the needle plate 5.

Figure 2:
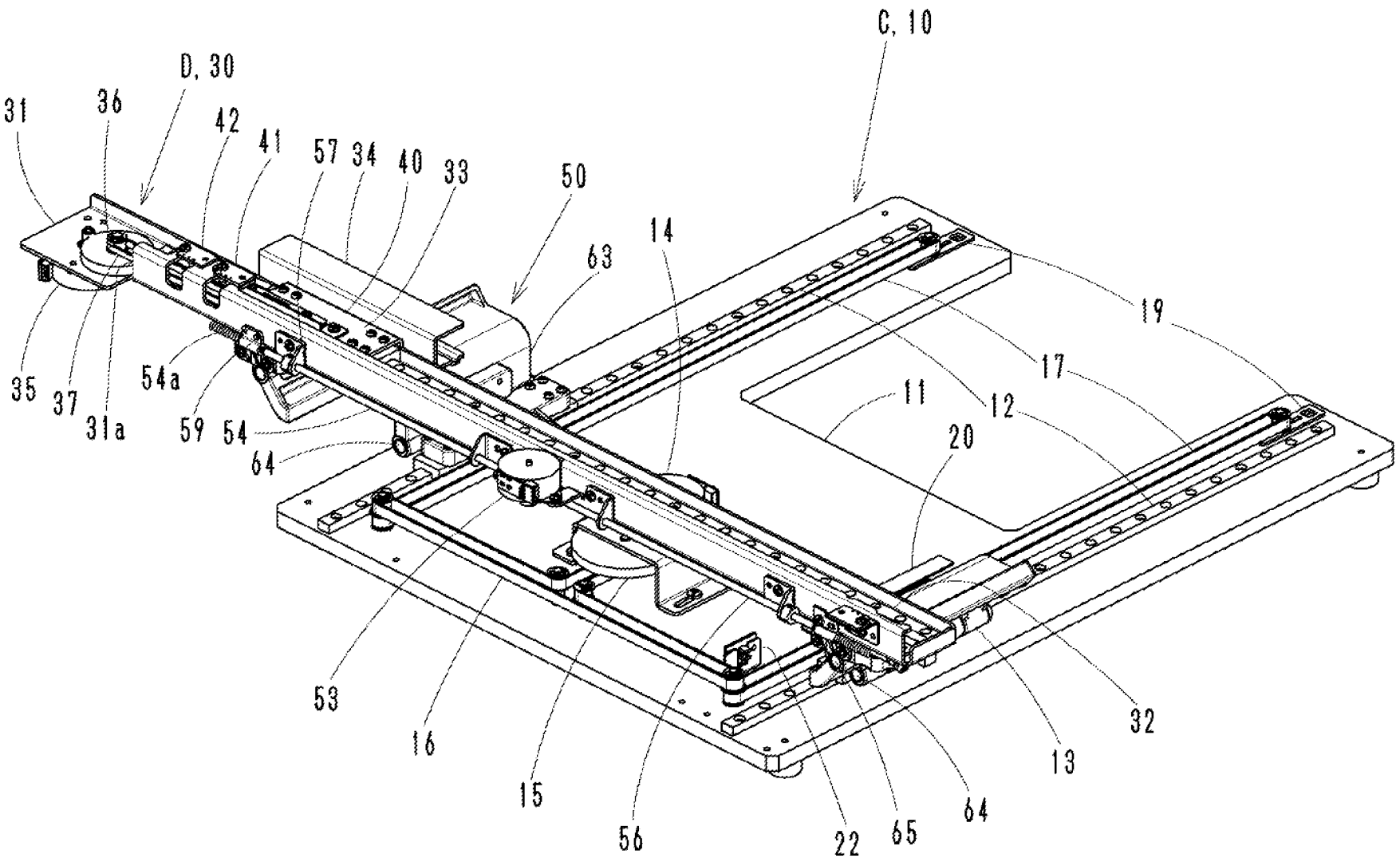
FIG. 2 is a perspective view illustrating an internal structure of the embroidery apparatus of the first example.

As illustrated in FIGS. 1 and 2, the main unit C of the embroidery apparatus B includes an X-direction translation mechanism 10 (second translation mechanism) and a Y-direction translation mechanism 30 (first translation mechanism). The X-direction translation mechanism 10 reciprocally moves the carriage unit D supported by an elevator mechanism 50 (to be described later) in the X direction that orthogonally intersects the Y direction (first direction). The Y-direction translation mechanism 30, which is accommodated in the carriage unit D, reciprocally moves an embroidery frame holder 34 in the Y direction. An embroidery frame (not illustrated) is attached to the embroidery frame holder 34. The main unit C has a body cover 8 of which an upper surface 8*a* serves as an auxiliary table. A recess 8*b* is formed in the body cover 8. The recess 8*b* is configured to fit the side surfaces of the bed section 1 of the sewing machine body A. Slits 8*c* are also formed in the body cover 8 so as to extend horizontally at the front and rear surfaces thereof, respectively.

Figure 3:
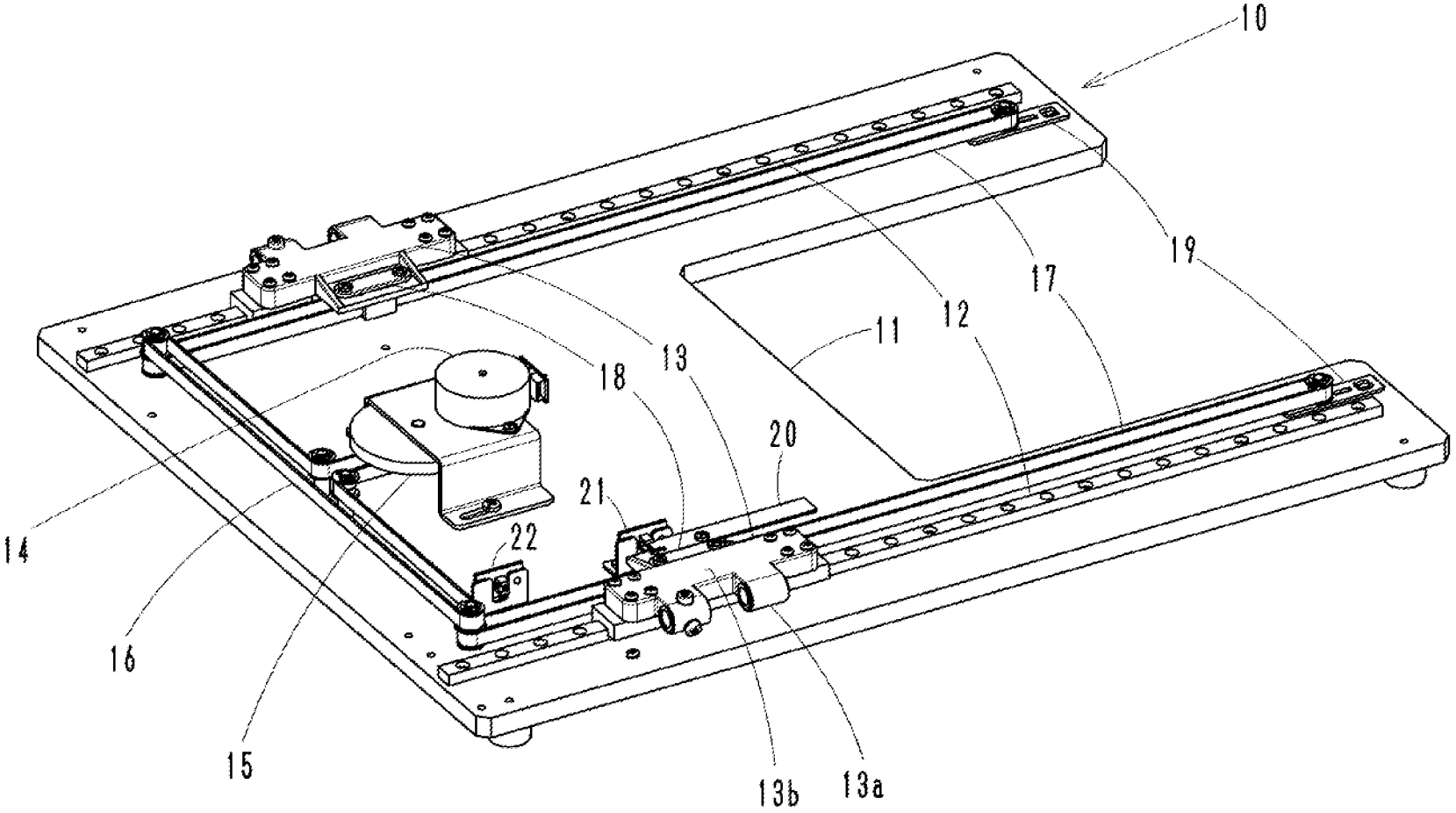
FIG. 3 is a perspective view illustrating an internal structure of an X-direction translation mechanism of the embroidery apparatus of the first example.

As illustrated in FIGS. 2 and 3, the X-direction translation mechanism 10 is disposed on a base plate 11 that is mounted in a lower portion of the body cover 8. The X-direction translation mechanism 10 includes a pair of first guide rails 12, a pair of first X-carriage guides 13, and an X-drive motor 14. The first guide rails 12 extend parallel to the X direction, and the first X-carriage guides 13 are mounted on respective first guide rails 12 so as to slide along in the X direction. The X-drive motor 14 drives the first X-carriage guides 13 using a first drive belt 16 and second drive belts 17.

The X-drive motor 14 rotates an X-idler pulley 15 that moves the first drive belt 16 reciprocally, and the reciprocal movement of the first drive belt 16 moves the second drive belts 17 reciprocally. The first X-carriage guides 13 include respective X-belt fixation bases 18 that are fixed to the second drive belts 17. Accordingly, the first X-carriage guides 13 move along the first guide rails 12 due to the reciprocal movement of the second drive belts 17.

An X-sensor screen 20 is attached to a first X-carriage guide 13. A first X-sensor 21 for detecting a home position and a second X-sensor 22 for detecting a storage position are disposed on the base plate 11 along the course of movement of the X-sensor screen 20. The first X-sensor 21 and the second X-sensor 22 serve as reference positions when the carriage unit D containing the Y-direction translation mechanism 30 (to be described later) moves in the X direction. X-pulley mounting plates 19 are provided for adjustment of the tension of respective second drive belts 17.

Figure 4:
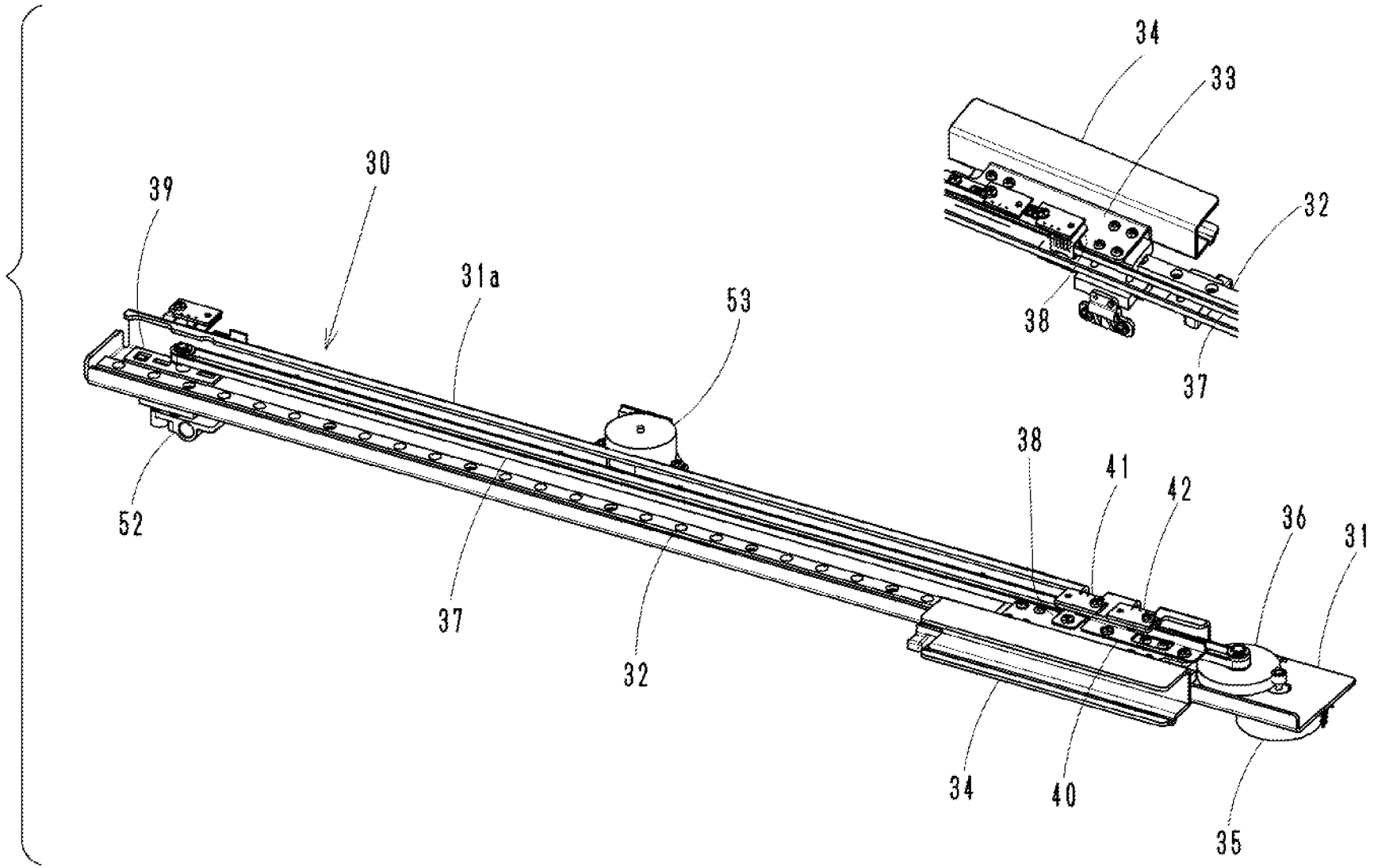
FIG. 4 is a perspective view illustrating an internal structure of a Y-direction translation mechanism of the embroidery apparatus of the first example.

As illustrated in FIGS. 2 and 4, the Y-direction translation mechanism 30 is disposed on a Y-carriage base plate 31 that is mounted in a lower portion of a carriage cover 29. The Y-direction translation mechanism 30 includes a second guide rail 32, a Y-carriage guide 33, and a Y-drive motor 35. The second guide rail 32 extends in the Y direction, and the Y-carriage guide 33 is mounted on the second guide rail 32 so as to slide the embroidery frame holder 34 along in the Y direction. The Y-drive motor 35 drives the Y-carriage guide 33 using a Y-drive belt 37.

The Y-drive motor 35 rotates a Y-idler pulley 36 that moves a Y-drive belt 37 reciprocally. The Y-carriage guide 33 includes a Y-belt fixation base 38 that is fixed to the Y-drive belt 37. Accordingly, the Y-carriage guide 33 moves along the second guide rail 32 in the Y direction due to the reciprocal movement of the Y-drive belt 37.

A Y-sensor screen 40 is attached to the Y-carriage guide 33. A first Y-sensor 41 for detecting a home position and a second Y-sensor 42 for detecting a storage position are disposed on the Y-carriage base plate 31 along the course of movement of the Y-sensor screen 40. The first Y-sensor 41 and the second Y-sensor 42 serve as reference positions when the embroidery frame holder 34 moves in the Y direction. A Y-pulley mounting plate 39 is provided for adjustment of the tension of the Y-drive belt 37.

Figure 5:
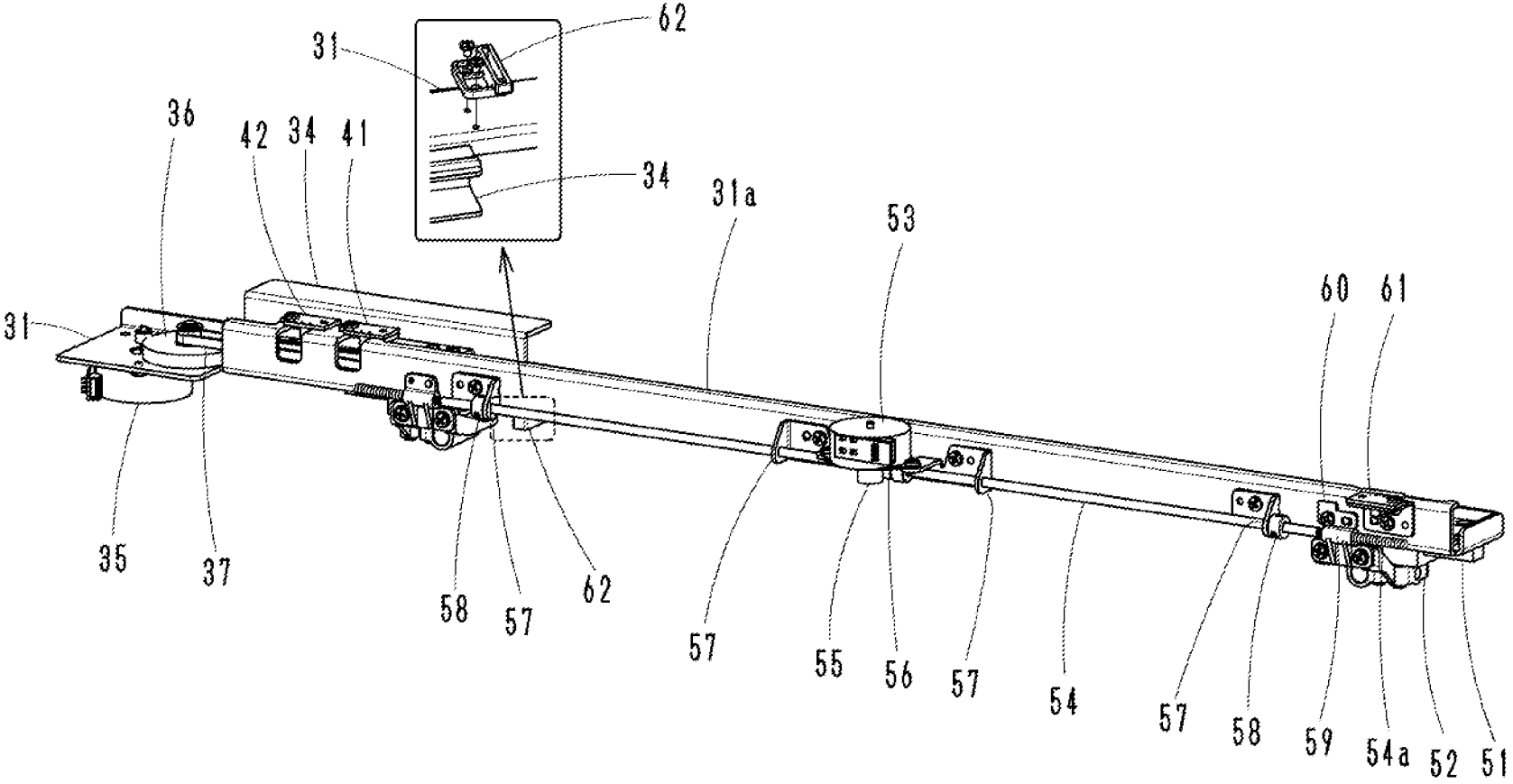
FIG. 5 is a perspective view illustrating an elevator mechanism disposed in the Y-direction translation mechanism of the embroidery apparatus of the first example.
Figure 6:
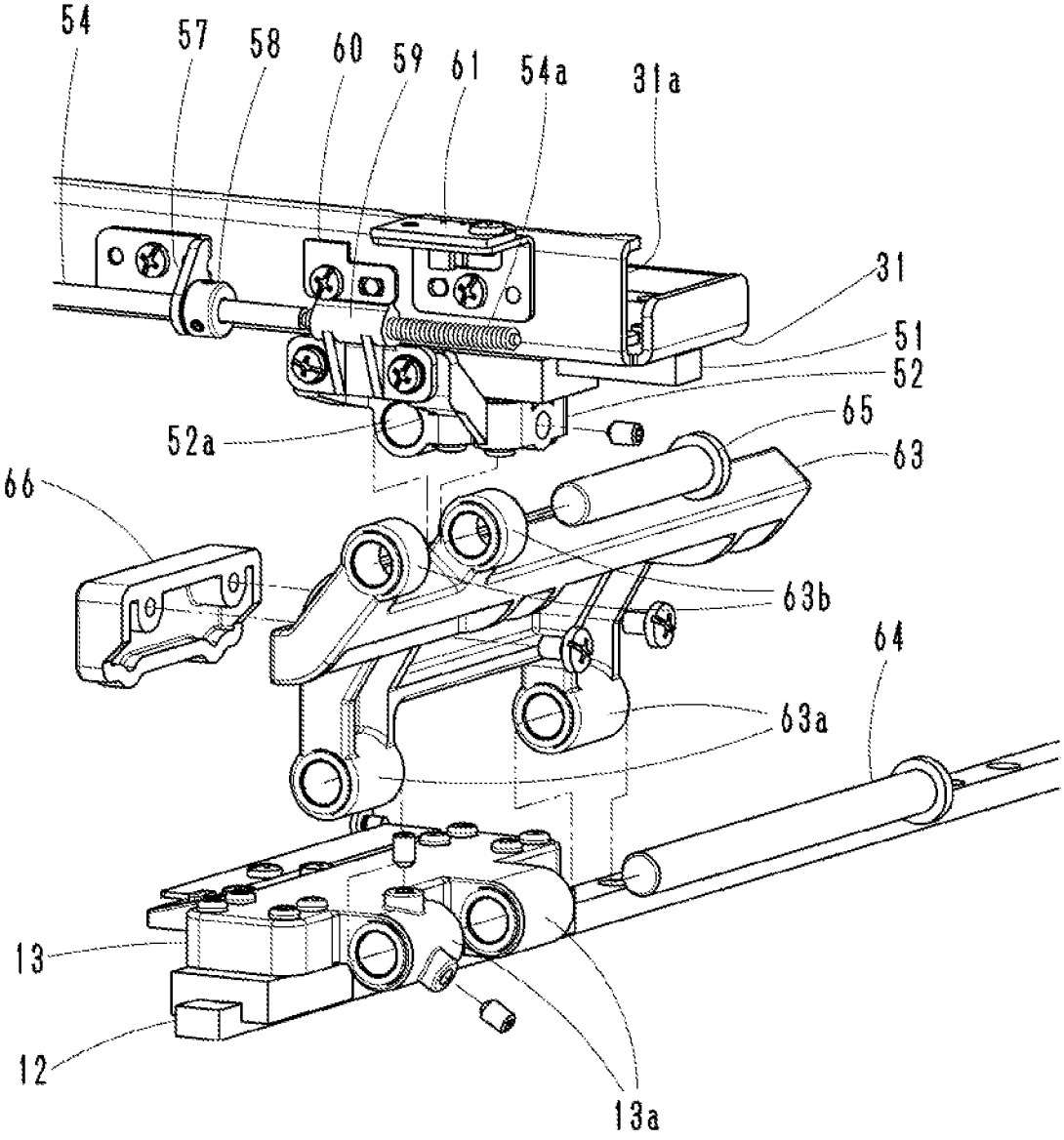
FIG. 6 is an exploded view illustrating part of the elevator mechanism of the embroidery apparatus of the first example.

As illustrated in FIGS. 2, 5, and 6, an elevator mechanism 50 is disposed between the first X-carriage guides 13 of the X-direction translation mechanism 10 and the Y-carriage base plate 31 of the Y-direction translation mechanism 30. To begin with, a portion of the elevator mechanism 50 near the Y-direction translation mechanism 30 is described as below. As illustrated in FIG. 5, the elevator mechanism 50 includes a pair of third guide rails 51 and a pair of first Y-carriage seats 52 at the bottom surface of the Y-carriage base plate 31. The elevator mechanism 50 also include an elevator driving shaft 54 and a first elevator motor 53. The third guide rails 51 are disposed respectively in front and rear portions of the Y-carriage base plate 31 so as to extend in the Y direction. The first Y-carriage seats 52 are mounted on respective third guide rails 51 and slide along in the Y direction. The elevator driving shaft 54 is disposed with the rotation axis extending in the Y direction, and the rotation of the elevator driving shaft 54 causes the first Y-carriage seats 52 to move. The first elevator motor 53 rotates the elevator driving shaft 54.

The first elevator motor 53 is attached to a standing plate 31*a* that stands at the Y-carriage base plate 31 and that extends in the Y direction. A worm gear 55 is fixed to the revolving shaft of the first elevator motor 53. The worm gear 55 of the first elevator motor 53 engages a worm wheel 56 that is fixed to a central portion of the elevator driving shaft 54 that are rotatably supported by drive shaft supports 57. A pair of bushes 58 being in sliding contact with corresponding drive shaft supports 57 prevent the elevator driving shaft 54 from being displaced in the thrusting directions.

The elevator driving shaft 54 has male screw portions 54*a* foamed at both ends thereof. The opposite male screw portions 54*a* are threaded in the opposite directions. The male screw portions 54*a* engage the internal threads of respective drive bases 59 that are fixed to the corresponding first Y-carriage seats 52. The worm gear 55 of the first elevator motor 53 rotates the worm wheel 56 fixed to the elevator driving shaft 54 at a reduced rotation speed. Rotation of the elevator driving shaft 54 thrusts the drive bases 59 in opposite directions along the third guide rails 51, thereby moving the first Y-carriage seats 52 fixed to the drive bases 59 in the corresponding thrusting directions along the third guide rails 51.

An elevator sensor screen 60 is attached to a drive base 59. An elevator sensor 61 for detecting a lower position is disposed at the standing plate 31*a* of the Y-carriage base plate 31 along the course of movement of the elevator sensor screen 60. The elevator sensor 61 serves as the reference position when the drive base 59 moves downward. A guide tab 62 is fixed to a rear portion of the Y-carriage base plate 31 at the bottom surface thereof. The guide tab 62 is configured to slide along a guiding groove 67 of the main unit C, which will be described later.

Next, the connection between the first Y-carriage seats 52 of the elevator mechanism 50 and the first X-carriage guides 13 of the X-direction translation mechanism 10 is described below. As illustrated in FIGS. 6 and 7, each first X-carriage guide 13 of the X-direction translation mechanism 10 has a fulcrum shaft bearing 13*a*. A Y-carriage support 63, which is a hinge arm, has a fulcrum engagement portion 63*a* formed at a first end of the Y-carriage support 63. The Y-carriage support 63 is pivotally connected to the first X-carriage guide 13 with a fulcrum shaft 64 engaging the fulcrum engagement portion 63*a* and the fulcrum shaft bearing 13*a*. In addition, each first Y-carriage seat 52, to which a corresponding drive base 59 is fixed, has a pivot bearing 52*a*. The Y-carriage support 63 also has a pivot engagement portion 63*b* formed at a second end of the Y-carriage support 63. The Y-carriage support 63 is pivotally connected to the first Y-carriage seat 52 with a pivot 65 engaging the pivot engagement portion 63*b* and the pivot bearing 52*a*. An abutting member 66 is fixed to a lower portion of the Y-carriage support 63 at the inside surface thereof.

Figure 7A:
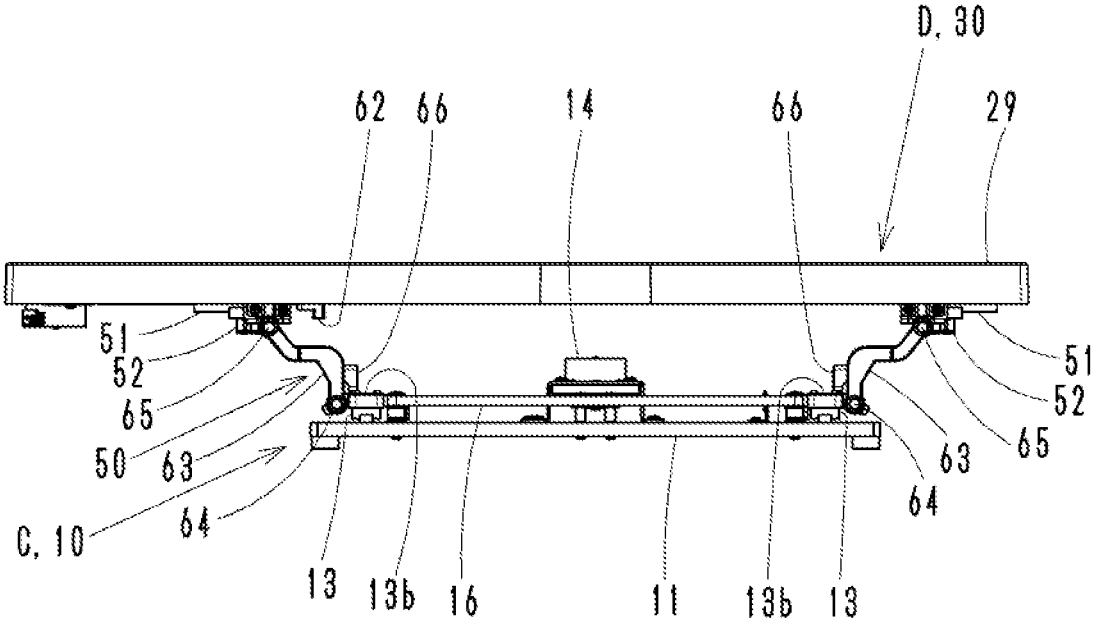
FIG. 7A is a left side view illustrating the elevator mechanism of the embroidery apparatus of the first example.
Figure 7B:
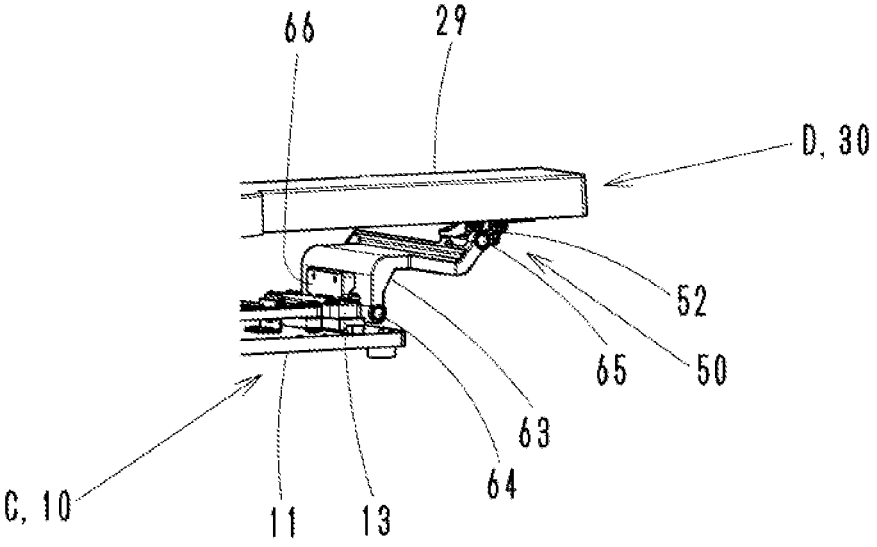
FIG. 7B is an enlarged perspective view illustrating part of the elevator mechanism of the embroidery apparatus of the first example.

The abutting member 66 is a device having the following function. As illustrated in FIG. 7A, a pair of the Y-carriage supports 63 movably connect between a pair of the first X-carriage guides 13 of the X-direction translation mechanism 10 and a pair of the first Y-carriage seats 52 of the elevator mechanism 50, respectively, using the fulcrum shafts 64 and the pivots 65, which forms a four-node link mechanism. Accordingly, the carriage unit D on which the first Y-carriage seats 52 are mounted moves freely within a certain range. The carriage unit D, however, needs to stay fixedly at a predetermined position in order to prevent a cloth from moving during stitching. Accordingly, as illustrated in detail in FIG. 7B, when the carriage unit D is raised and stays on the upper surface of the main unit C during embroidery stitching, the abutting members 66 prevent the Y-carriage support 63 from moving unstably.

A fixation portion of the Y-carriage support 63 to which each abutting member 66 is fixed is adjustable to change the height position of the abutting member 66. Accordingly, each of the right and left abutting members 66 is adjusted appropriately so that each abutting member 66 can abut a flat surface 13*b* of the corresponding first X-carriage guide 13 at an appropriate position, which thereby enables the carriage unit D to be stably fixed to the Y-carriage support 63.

Figure 8:
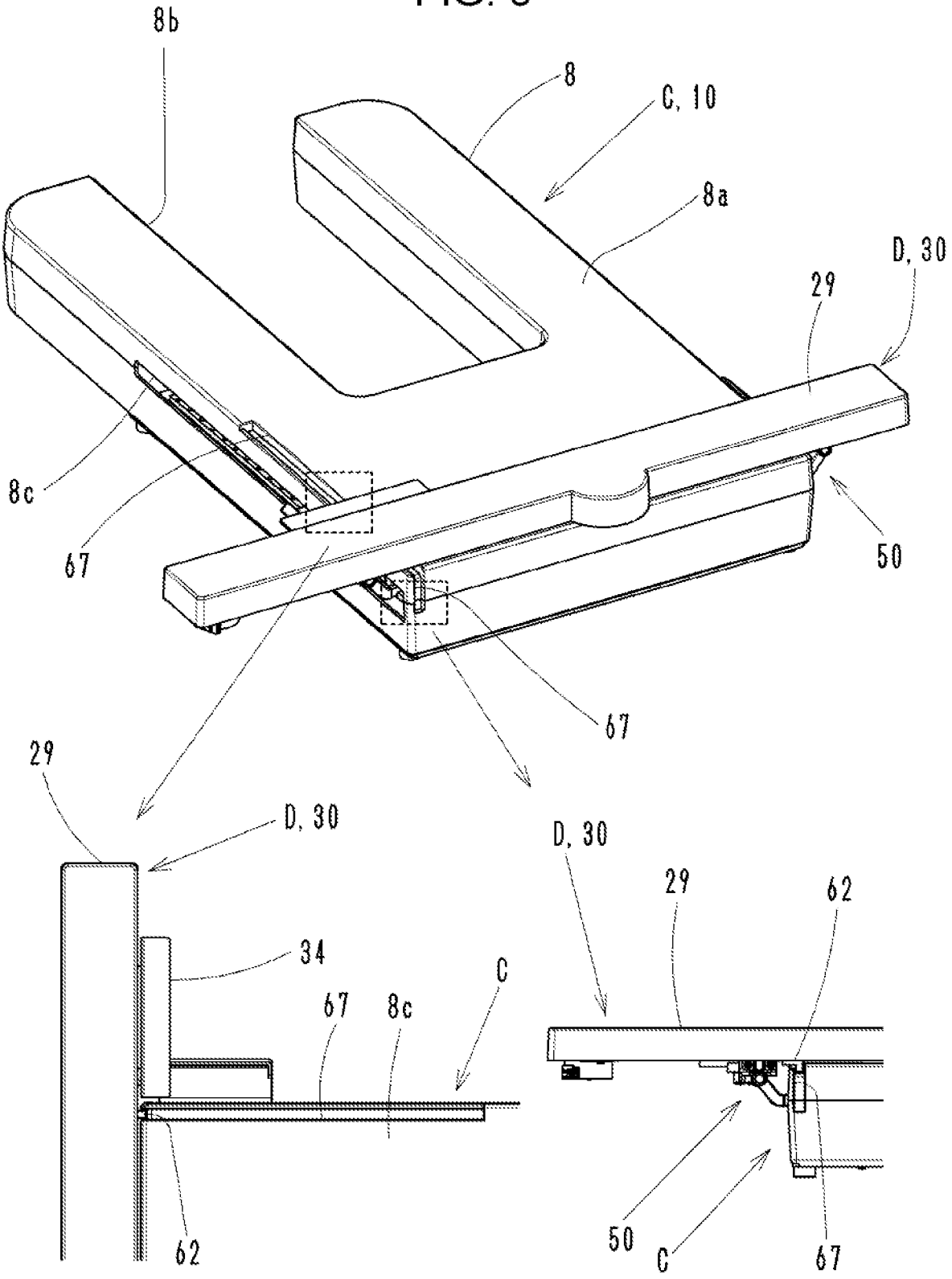
FIG. 8 is a perspective view illustrating an external appearance of the embroidery apparatus of the first example.

Moreover, as illustrated in FIG. 8, the body cover 8 of the main unit C has the guiding groove 67 that is formed at the upper surface 8*a* and the left side surface of the body cover 8 so as to extend in the X direction in a rear end portion of the body cover 8. In addition, the guide tab 62 is formed at the bottom surface of the Y-carriage base plate 31 at a position immediately above the guiding groove 67. The guide tab 62 engages the guiding groove 67, which can prevent the carriage unit D from moving in the front-rear direction (Y direction).

Figure 9A:
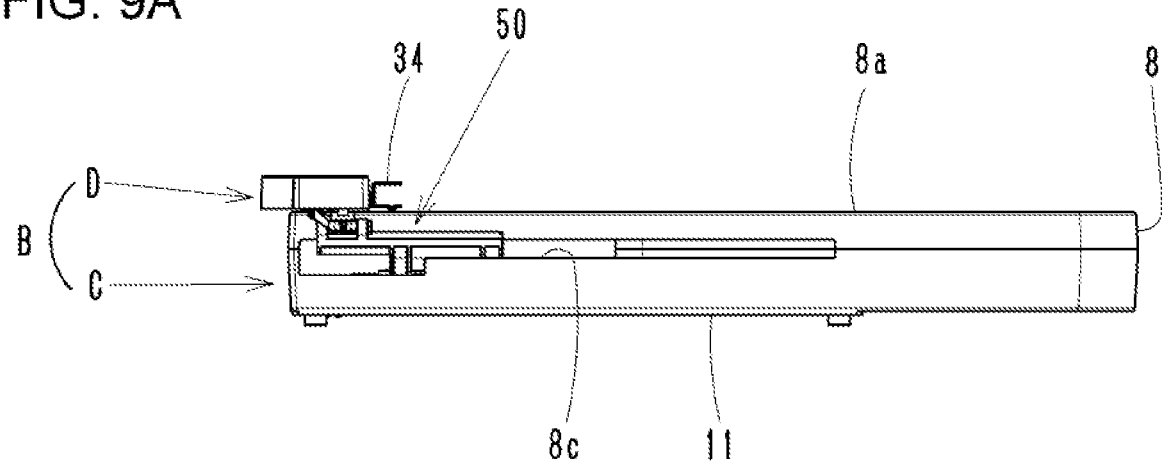
FIG. 9A is a front view illustrating a carriage unit of the embroidery apparatus of the first example, in which the carriage unit is positioned at a home position.

Next, operation and advantageous effects of the present example will be described. In the case of the embroidery apparatus B starting embroidery stitching, as illustrated in FIG. 9A, the carriage unit D is at the home position at which embroidery stitching can be started at the upper surface 8*a* of the main unit C. Here, as illustrated in FIGS. 2 and 3, the first X-carriage guides 13 of the X-direction translation mechanism 10 support the carriage unit D using the elevator mechanism 50.

Figure 10A:
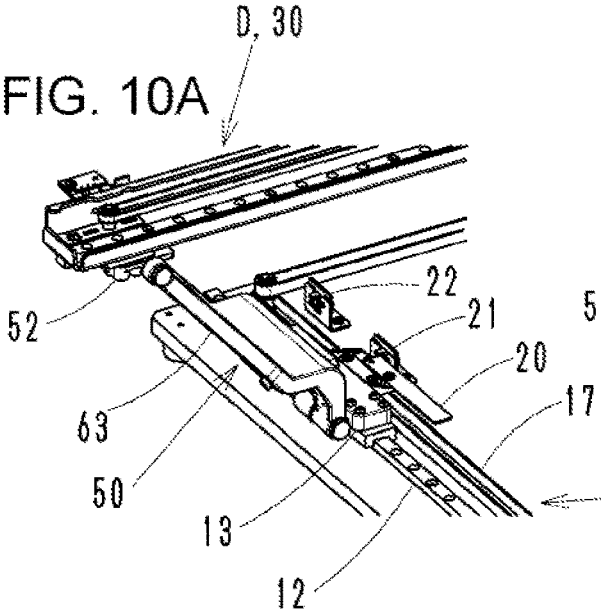
FIG. 10A is a perspective view illustrating a home position of the X-direction translation mechanism of the embroidery apparatus of the first example.

The first X-carriage guides 13 are fixed to respective second drive belts 17 that are reciprocally moved by the reciprocal movement of the first drive belt 16 driven by the X-drive motor 14. The first X-carriage guides 13 are thereby movable along the first guide rails 12 in the X direction. When the carriage unit D is at the home position as illustrated in FIG. 10A, the X-sensor screen 20 attached to a first X-carriage guide 13 masks the first X-sensor 21 disposed at the base plate 11 for detecting the home position.

Figure 10B:
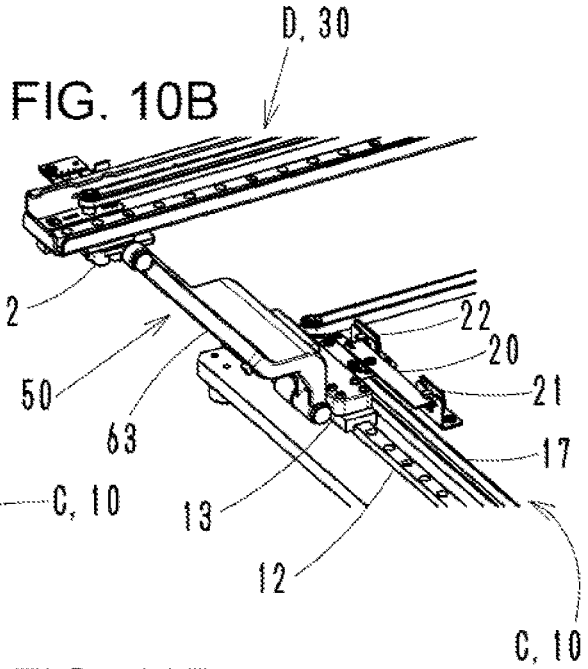
FIG. 10B is a perspective view illustrating a storage position of the X-direction translation mechanism of the embroidery apparatus of the first example.
Figure 10C:
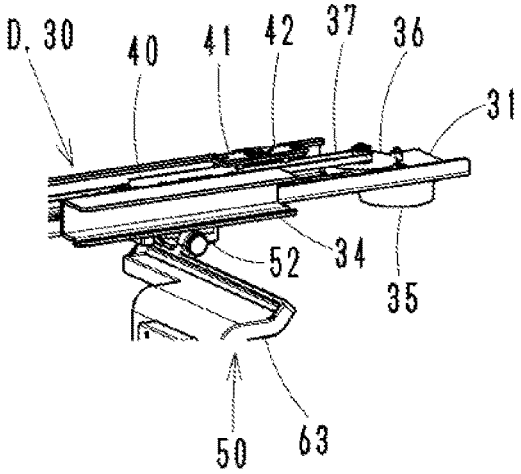
FIG. 10C is a perspective view illustrating the Y-direction translation mechanism of the embroidery apparatus of the first example, in which the Y-direction translation mechanism is positioned at a home position.
Figure 10D:
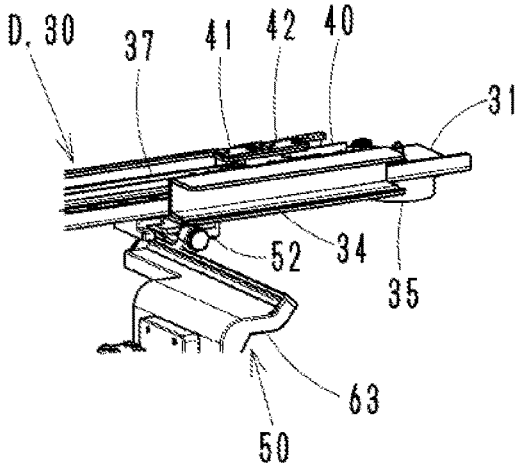
FIG. 10D is a perspective view illustrating the Y-direction translation mechanism of the embroidery apparatus of the first example, in which the Y-direction translation mechanism is positioned at a storage position.
Figure 10E:
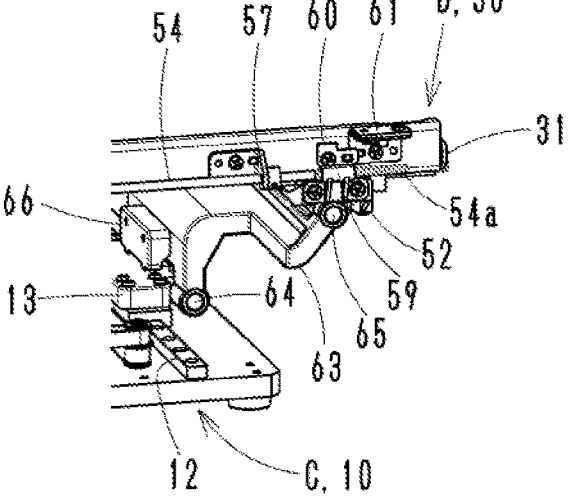
FIG. 10E is a perspective view illustrating an upper position of the elevator mechanism of the embroidery apparatus of the first example.

Similarly, as illustrated in FIG. 4, the Y-direction translation mechanism 30 has the Y-carriage guide 33 configured to slide the embroidery frame holder 34 in the Y direction. The Y-carriage guide 33 is fixed to the Y-drive belt 37 that is reciprocally moved by the Y-drive motor 35. The Y-carriage guide 33 is thereby movable along the second guide rail 32 in the Y direction. When the embroidery frame holder 34 of the Y-direction translation mechanism 30 is at the home position as illustrated in FIG. 10C, the Y-sensor screen 40 attached to the Y-carriage guide 33 masks the first Y-sensor 41 disposed at the Y-carriage base plate 31 for detecting the home position. The elevator sensor screen 60 attached to a drive base 59 of the elevator mechanism 50, however, does not mask the elevator sensor 61 for detecting the lower position, as illustrated in FIG. 10E. Note that at the start of embroidery stitching using the embroidery apparatus B, a user needs to mount an embroidery frame with a cloth (not illustrated) onto the embroidery frame holder 34.

Next, an operation for switching to standard stitching after the embroidery stitching is completed is described as follows. When the embroidery stitching is completed, the carriage unit D automatically returns to the home position illustrated in FIG. 9A, while the guide tab 62 fixed at the lower surface of the carriage unit D engages the guiding groove 67 formed at the upper surface of the main unit C as illustrated in FIG. 8. The user subsequently detaches the embroidery frame with a stitched cloth from the embroidery frame holder 34 of the Y-direction translation mechanism 30. Subsequently, when the user touches a switching button for switching to the standard stitching, which is displayed at the display 6 of the sewing machine body A, a control device in the sewing machine body A issues a storage instruction to the embroidery apparatus B upon receiving the request of switching to the standard stitching from the switching button.

Upon receiving the storage instruction, the embroidery apparatus B starts the Y-drive motor 35 of the Y-direction translation mechanism 30 disposed in the carriage unit D, which causes the Y-carriage guide 33 with the embroidery frame holder 34 mounted thereon to move rearward. As illustrated in FIG. 10D, the Y-carriage guide 33 moves, and the Y-sensor screen 40 attached to the Y-carriage guide 33 subsequently masks the second Y-sensor 42 disposed at the Y-carriage base plate 31 for detecting the storage position. As a result, the Y-drive motor 35 stops moving the Y-carriage guide 33 rearward, and the carriage unit D holding the embroidery frame holder 34 stops at the storage position outside the main unit C, as illustrated in FIG. 8.

Figure 9B:
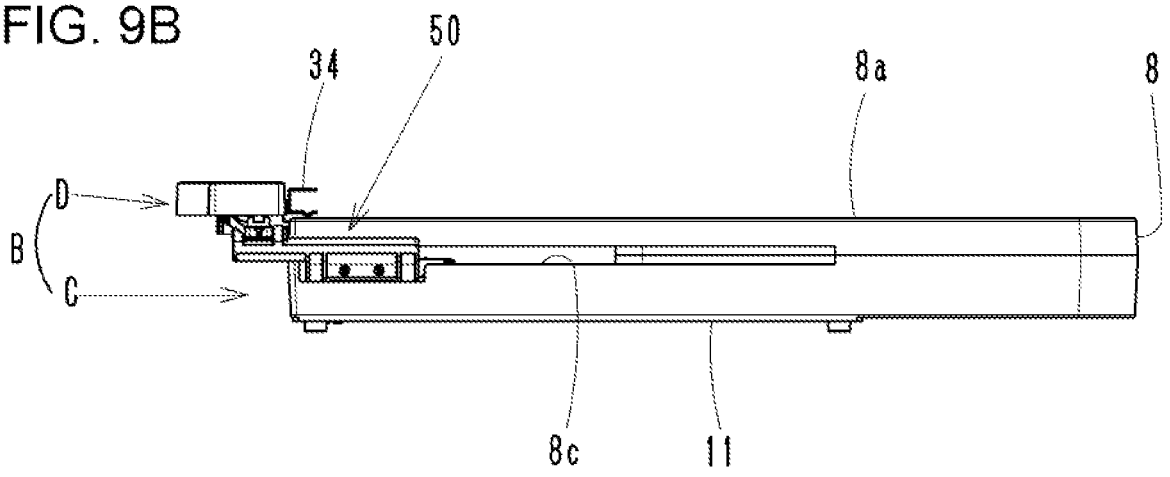
FIG. 9B is a front view illustrating the carriage unit of the embroidery apparatus of the first example, in which the carriage unit is positioned at a storage-ready position.

Simultaneously, the embroidery apparatus B starts the X-drive motor 14 of the X-direction translation mechanism 10 disposed in the main unit C, which moves the first X-carriage guides 13 leftward. As illustrated in FIG. 10B, the first X-carriage guides 13 move, and the X-sensor screen 20 attached to the corresponding first X-carriage guide 13 subsequently masks the second X-sensor 22 disposed at the base plate 11 for detecting the storage position. As a result, the X-drive motor 14 stops moving the first X-carriage guides 13 leftward, and the main unit C holds the carriage unit D at the storage position outside the main unit C by using the elevator mechanism 50, as illustrated in FIG. 9B.

The embroidery apparatus B issues a first storage-ready notification when the Y-sensor screen 40 attached to the Y-carriage guide 33 of the Y-direction translation mechanism 30 masks the second Y-sensor 42 for detecting the storage position. The embroidery apparatus B issues a second storage-ready notification when the X-sensor screen 20 attached to the first X-carriage guide 13 of the X-direction translation mechanism 10 masks the second X-sensor 22 for detecting the storage position.

Upon receiving the first storage-ready notification and the second storage-ready notification, the elevator mechanism 50 starts the first elevator motor 53 to rotate the elevator driving shaft 54. The elevator driving shaft 54 is screwed into the drive bases 59 that are fixed to respective first Y-carriage seats 52. The rotation of the elevator driving shaft 54 moves the first Y-carriage seats 52 along the carriage unit D in opposite directions, in other words, in directions away from each other. Each first Y-carriage seat 52 is pivotally connected to the second end (pivot engagement portion 63*b*) of the corresponding Y-carriage support 63 using the pivot 65, and the first end (fulcrum engagement portion 63*a*) of the Y-carriage support 63 is pivotally connected to the corresponding first X-carriage guide 13 using fulcrum shaft 64. When the first Y-carriage seats 52 move toward the opposite ends of the carriage unit D, each Y-carriage support 63 turns outward while pivoting on the first end (fulcrum engagement portion 63*a*) so as to increase the distance between the second ends (pivot engagement portions 63*b*) of respective Y-carriage supports 63. This causes the carriage unit D to descend with the guide tab 62 of the carriage unit D sliding along the guiding groove 67 formed at the left surface of the main unit C.

Figure 9C:
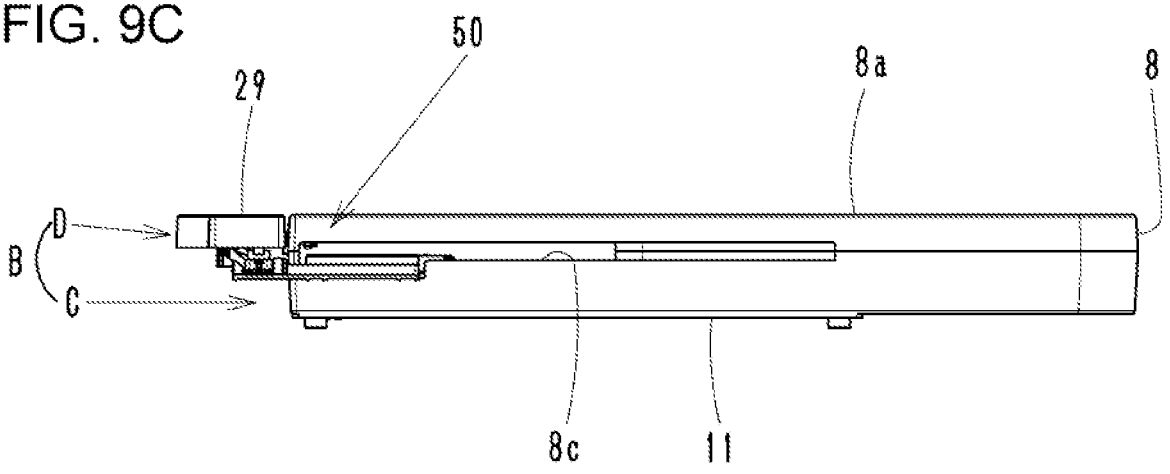
FIG. 9C is a front view illustrating the carriage unit of the embroidery apparatus of the first example, in which the carriage unit is positioned at a storage-completion position.
Figure 10F:
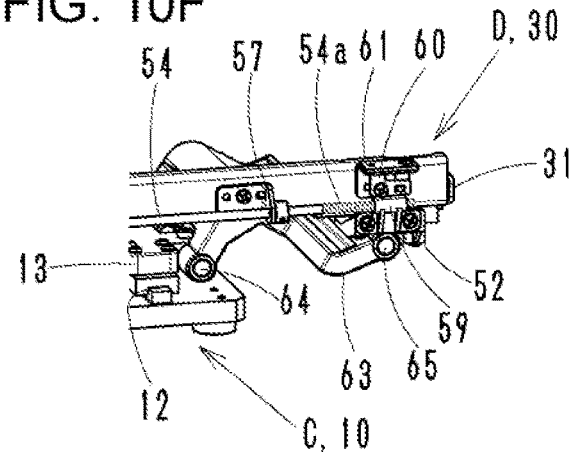
FIG. 10F is a perspective view illustrating a lower position of the elevator mechanism of the embroidery apparatus of the first example.

As illustrated in FIG. 10F, the first Y-carriage seats 52 move, and the carriage unit D descends horizontally. The elevator sensor screen 60 attached to the corresponding drive base 59 masks the elevator sensor 61 disposed at the standing plate 31*a* of the Y-carriage base plate 31 for detecting the lower position. The first elevator motor 53 stops moving the drive bases 59 toward the opposite ends. As a result, as illustrated in FIG. 9C, the carriage unit D is stored such that the upper surface of the carriage cover 29 is flush with the upper surface 8*a* of the body cover 8 of the main unit C. In this state, the user can perform standard stitching on the bed section 1 of the sewing machine body A while utilizing the upper surface 8*a* of the body cover 8 of the main unit C and the upper surface of the carriage cover 29 of the carriage unit D as an auxiliary table.

Next, an operation for switching to the embroidery stitching after the standard stitching is completed is described as follows. When the user returns to the embroidery stitching from the standard stitching, the user touches a switching button for switching to the embroidery stitching, which is displayed at the display 6 of the sewing machine body A, the control device in the sewing machine body A issues a returning-to-home-position instruction to the embroidery apparatus B upon receiving the request of switching to the embroidery stitching from the switching button.

Upon receiving the returning-to-home-position instruction, the embroidery apparatus B starts the first elevator motor 53 of the elevator mechanism 50 to rotate the elevator driving shaft 54. The elevator driving shaft 54 is screwed into the drive bases 59 that are fixed to the first Y-carriage seats 52. Rotation of the elevator driving shaft 54 moves the first Y-carriage seats 52 closer to each other toward the center of the carriage unit D. Each first Y-carriage seat 52 is pivotally connected to the second end (pivot engagement portion 63*b*) of the corresponding Y-carriage support 63 using the pivot 65, and the first end (fulcrum engagement portion 63*a*) of the Y-carriage support 63 is pivotally connected to the corresponding first X-carriage guide 13 using fulcrum shaft 64. When the first Y-carriage seats 52 move toward the center of the carriage unit D, each Y-carriage support 63 turns inward while pivoting on the first end (fulcrum engagement portion 63*a*) so as to decrease the distance between the second ends (pivot engagement portions 63*b*) of respective Y-carriage supports 63. The carriage unit D thereby ascends with the guide tab 62 of the carriage unit D sliding along the guiding groove 67 of the main unit C.

As illustrated in FIG. 7A, the first Y-carriage seats 52 move and the carriage unit D ascends horizontally. Here, the number of rotation of the elevator driving shaft 54 is counted to the upper position from the lower position that has been detected by the elevator sensor 61 for detecting the lower position. The number counted is compared with a predetermined number of rotation of the elevator driving shaft 54. The first elevator motor 53 stops moving the drive bases 59 toward the center of the carriage unit D when the number counted reaches the predetermined number. As a result, as illustrated in FIG. 9B, the carriage unit D is held at a position higher than the upper surface 8*a* of the body cover 8 of the main unit C. Upon completion of this return-preparation operation, the elevator mechanism 50 issues a return-preparation completion notification to the embroidery apparatus B.

Upon receiving the return-preparation completion notification, the embroidery apparatus B starts the Y-drive motor 35 of the Y-direction translation mechanism 30 disposed in the carriage unit D, which causes the Y-carriage guide 33 with the embroidery frame holder 34 attached thereto to move frontward. As illustrated in FIG. 10C, the Y-carriage guide 33 moves, and the Y-sensor screen 40 attached to the Y-carriage guide 33 masks the first Y-sensor 41 disposed at the Y-carriage base plate 31 for detecting the home position. As a result, the Y-drive motor 35 thereby stops moving the Y-carriage guide 33 frontward, and the carriage unit D holding the embroidery frame holder 34 stops at the home position.

Simultaneously, the embroidery apparatus B starts the X-drive motor 14 of the X-direction translation mechanism 10 disposed in the main unit C, which moves the first X-carriage guides 13 rightward. As illustrated in FIG. 10A, the first X-carriage guides 13 move, and the X-sensor screen 20 attached to the corresponding first X-carriage guide 13 subsequently masks the first X-sensor 21 disposed at the base plate 11 for detecting the home position. As a result, the X-drive motor 14 stops moving the first X-carriage guides 13 rightward, and the main unit C holds the carriage unit D at the home position by using the elevator mechanism 50, as illustrated in FIG. 9A. Note that a normal spur gear may be used to connect the first elevator motor 53 with the elevator driving shaft 54 in the elevator mechanism 50. In this case, energizing the first elevator motor 53 can prevent the carriage unit D from descending due to its own load when the elevator driving shaft 54 stops. In the present example, however, the first elevator motor 53 and the elevator driving shaft 54 are connected using the worm gear 55 and the worm wheel 56. This self-locking mechanism can prevent the elevator driving shaft 54 from rotating unexpectedly, which eliminates the necessity of energizing the first elevator motor 53 while the elevator driving shaft 54 stops.

As described above, the embroidery apparatus B of the present example is able to execute the switching operation automatically from the embroidery stitching to the standard stitching and also from the standard stitching to the embroidery stitching. In addition, in the embroidery apparatus B, the carriage unit D is supported by the elevator mechanism 50 at the sides of the main unit C. This enables the upper surface 8*a* of the body cover 8 of the main unit C and the upper surface of the carriage cover 29 of the carriage unit D to be used as the auxiliary table during the standard stitching.

Second Example

Next, a second example will be described. In the second example, the structure of the elevator mechanism 50 of the first example is changed. In the present example, the same elements as those described in the first example will be denoted by the same reference symbols. Description of the second example is directed to differences from the first example, while duplicated description is omitted.

Figure 15:
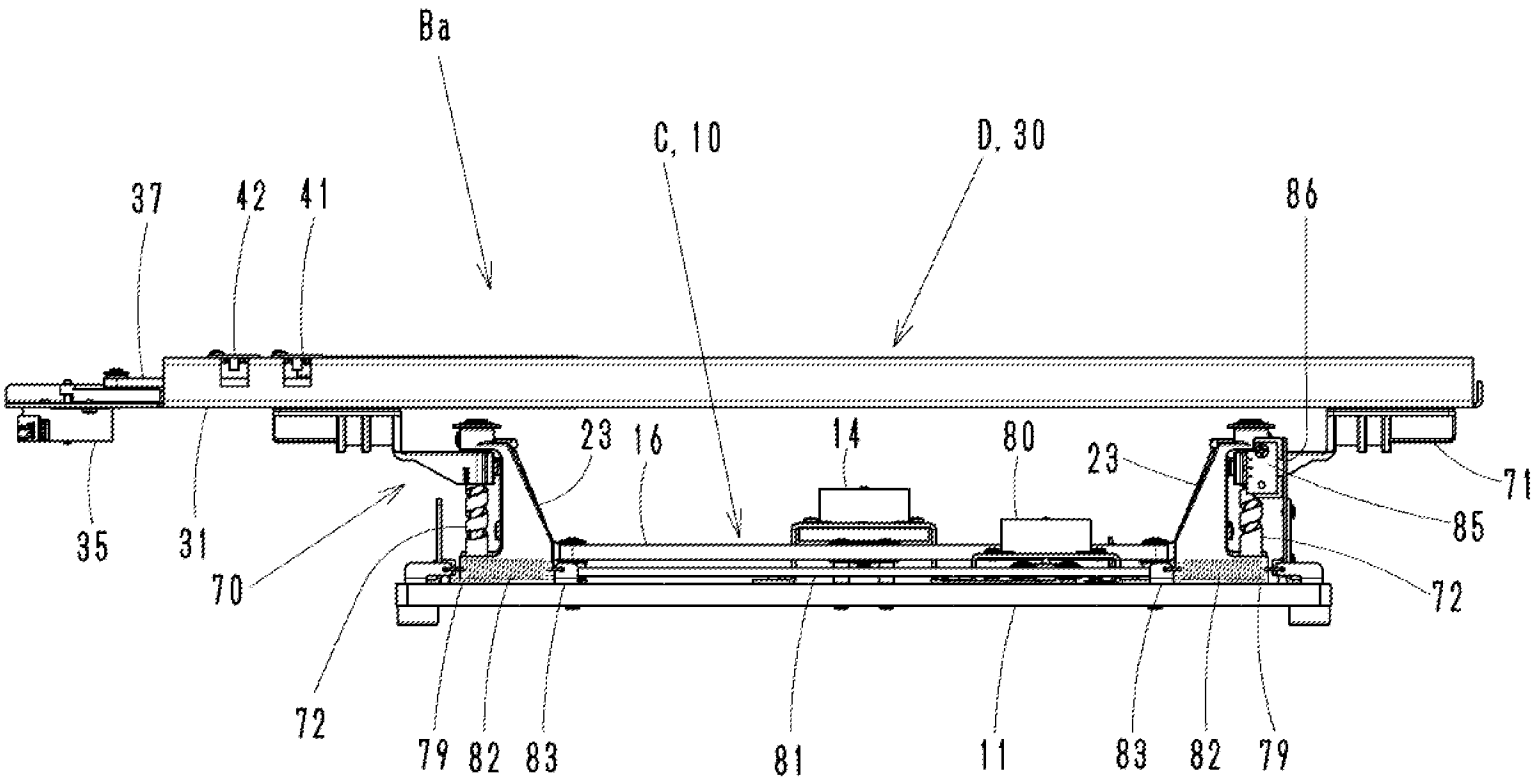
FIG. 15 is a left side view illustrating the embroidery apparatus of the second example.

In FIGS. 11 and 15, reference Ba denotes an embroidery apparatus. The embroidery apparatus Ba includes the main unit C in which the X-direction translation mechanism 10 is disposed. The X-direction translation mechanism 10 supports the carriage unit D using an elevator mechanism 70 (to be described later) and reciprocally moves the carriage unit D in the X direction. The embroidery apparatus Ba also includes the carriage unit D in which the Y-direction translation mechanism 30 is disposed. The carriage unit D moves along the upper surface of the main unit C in the X direction. The Y-direction translation mechanism 30 reciprocally moves the embroidery frame holder 34 in the Y direction.

As illustrated in FIG. 11, the X-direction translation mechanism 10, which is disposed on the base plate 11, includes a pair of the first guide rails 12, a pair of second X-carriage guides 23, and the X-drive motor 14. The first guide rails 12 extend parallel to the X direction, and the second X-carriage guides 23 are mounted on respective first guide rails 12 so as to slide along in the X direction. The X-drive motor 14 drives the second X-carriage guides 23 using the first drive belt 16 and the second drive belts 17. The X-sensor screen 20 is attached to a second X-carriage guide 23. The first X-sensor 21 for detecting the home position and the second X-sensor 22 for detecting the storage position are disposed on the base plate 11 along the course of movement of the X-sensor screen 20.

The Y-direction translation mechanism 30 is disposed on the Y-carriage base plate 31. The Y-direction translation mechanism 30 includes the second guide rail 32, the Y-carriage guide 33, and the Y-drive motor 35. The second guide rail 32 extends in the Y direction, and the Y-carriage guide 33 is mounted on the second guide rail 32 and slides the embroidery frame holder 34 along in the Y direction. The Y-drive motor 35 drives the Y-carriage guide 33 using the Y-drive belt 37. The Y-sensor screen 40 is attached to the Y-carriage guide 33. The first Y-sensor 41 for detecting the home position and the second I-sensor 42 for detecting the storage position are disposed on the Y-carriage base plate 31 along the course of movement of the Y-sensor screen 40.

Figure 11A:
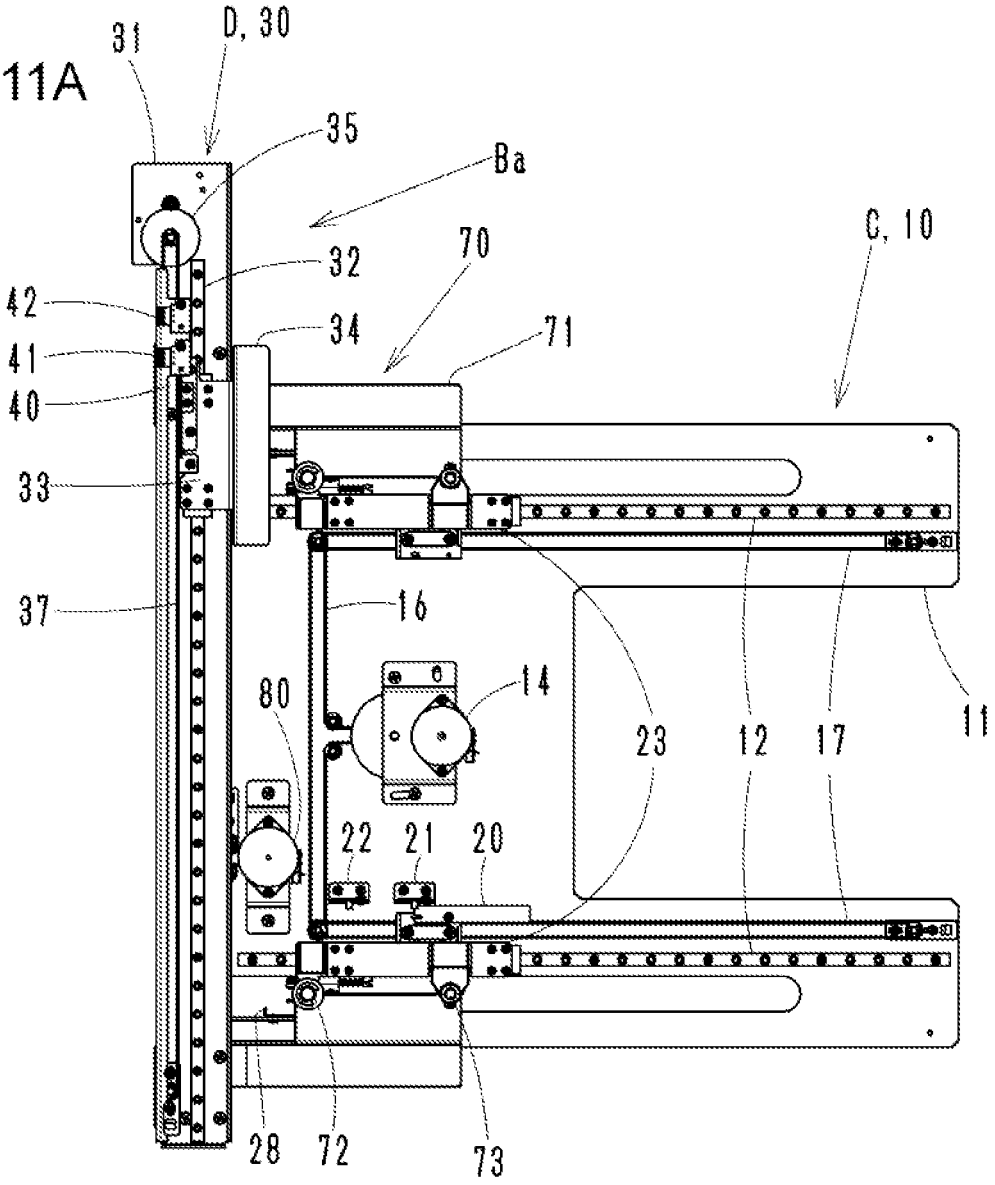
FIG. 11A is a top view illustrating an internal structure of an embroidery apparatus according to a second example of the present invention.
Figure 11B:
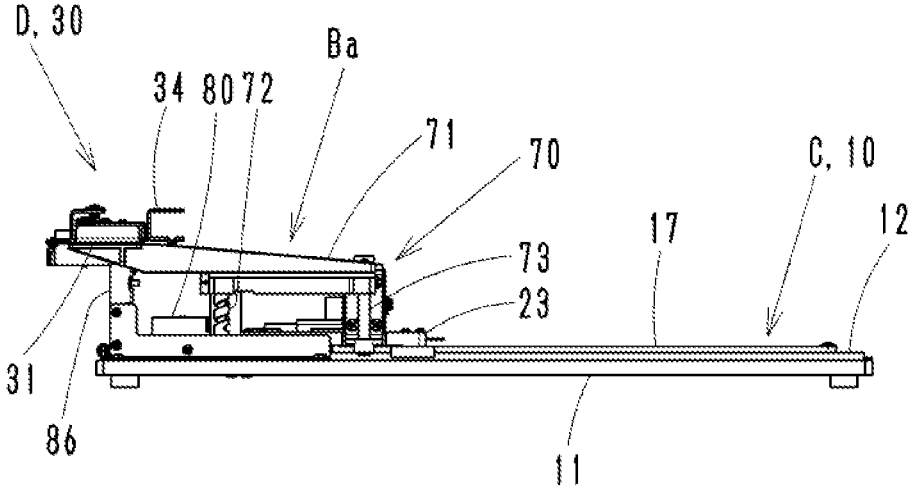
FIG. 11B is a front view illustrating the internal structure of the embroidery apparatus according to the second example.

As illustrated in FIGS. 11A, 11B, and 15, an elevator mechanism 70 is disposed between each second X-carriage guide 23 of the X-direction translation mechanism 10 and the Y-carriage base plate 31 of the Y-direction translation mechanism 30. As illustrated in FIGS. 12A to 14, the elevator mechanism 70 includes a pair of second Y-carriage seats 71 that support respective front and rear portions of the Y-carriage base plate 31 of the Y-direction translation mechanism 30 at the bottom surface of the Y-carriage base plate 31. Each second Y-carriage seat 71 has a first throughhole 71*a* and a second throughhole 71*b*. An elevator shaft 72 and a guide shaft 73 are disposed at each second X-carriage guide 23 of the X-direction translation mechanism 10. The elevator shaft 72 and the guide shaft 73 of each second X-carriage guide 23 engage the first throughhole 71*a* and the second throughhole 71*b* of the corresponding second Y-carriage seat 71, respectively.

Figure 12A:
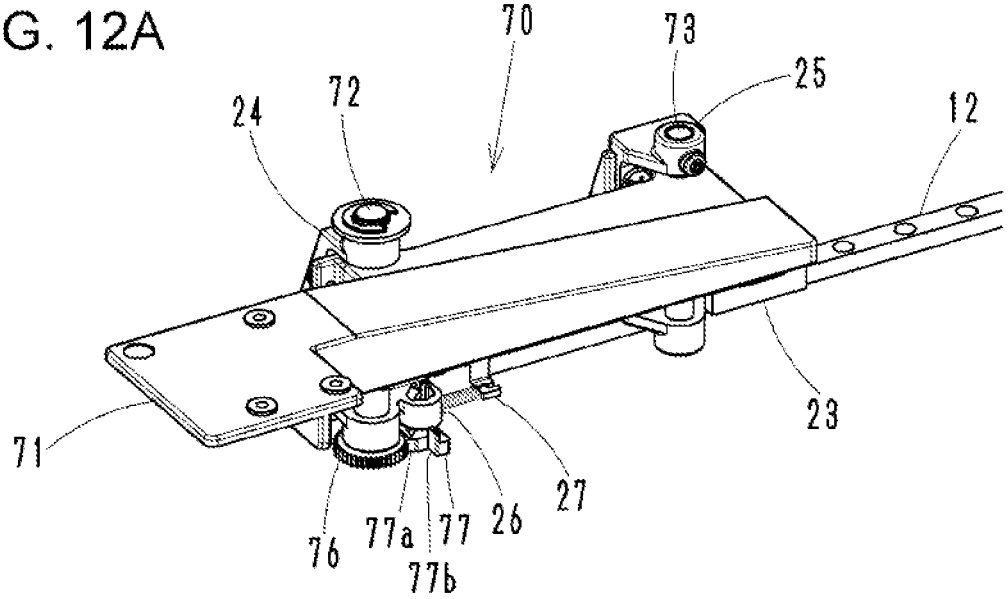
FIG. 12A is a view illustrating part of an assembled elevator mechanism of the embroidery apparatus of the second example.
Figure 12B:
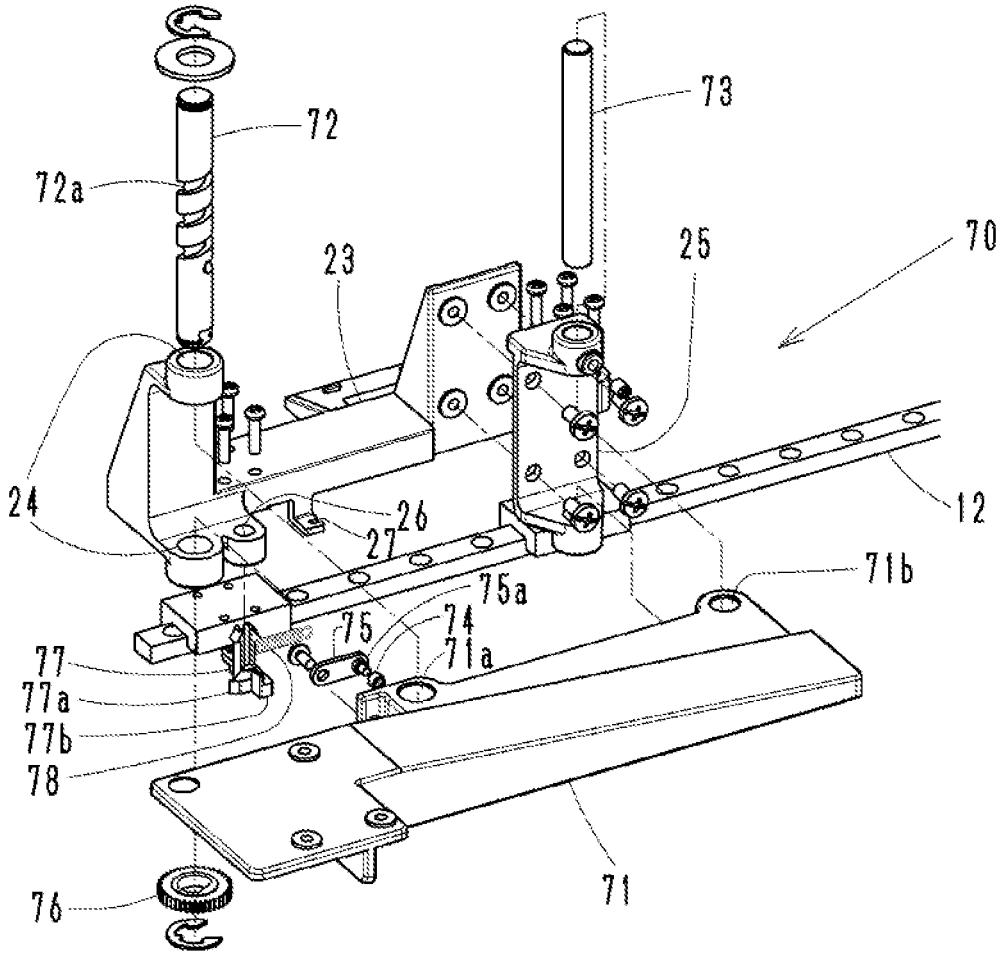
FIG. 12B is an exploded view illustrating part of the elevator mechanism of the embroidery apparatus of the second example.
Figure 13A:
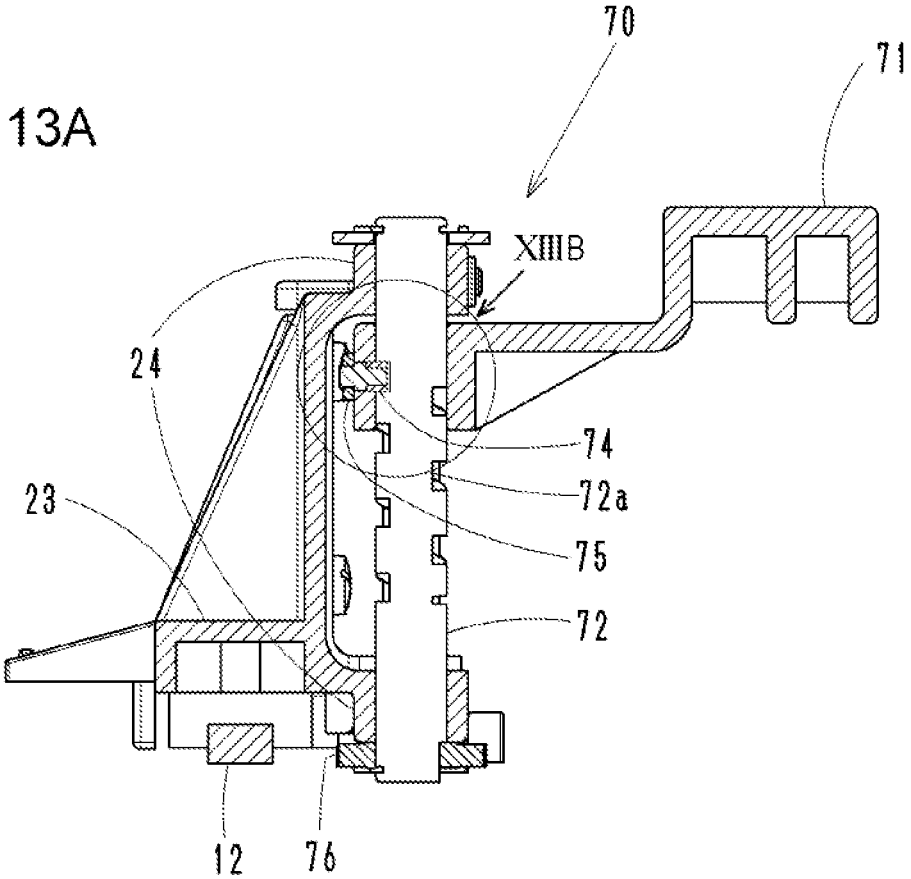
FIG. 13A is a sectional side view illustrating part of the elevator mechanism of the embroidery apparatus of the second example.
Figure 13B:
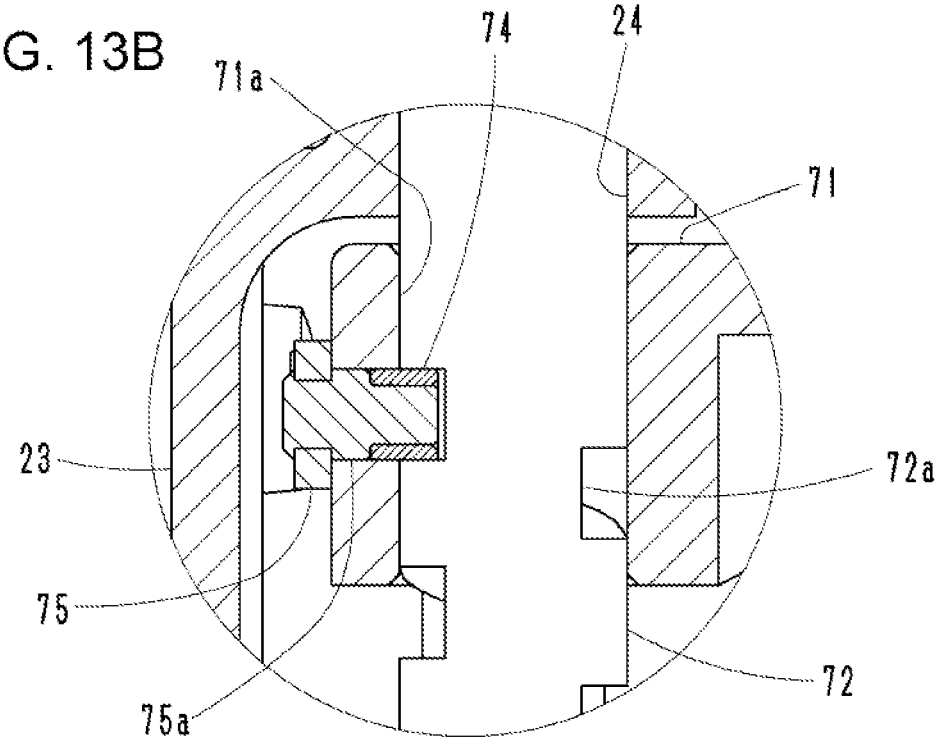
FIG. 13B is an enlarged view illustrating part of the elevator mechanism of the embroidery apparatus of the second example, in which the part of the mechanism is indicated in FIG. 13A.

As illustrated in FIGS. 12A and 12B, each elevator shaft 72*a* has a spiral groove 72*a* formed on the surface thereof, and the spiral groove 72*a* has horizontal upper and lower dead ends. The elevator shaft 72 is rotatably supported by elevator shaft bearings 24 formed at the second X-carriage guide 23. Each guide shaft 73 is fixed to a guide shaft holder 25 attached to the second X-carriage guide 23 so as not to rotate.

As illustrated in FIGS. 12A to 13B, a cam mounting plate 75 is attached to each second Y-carriage seat 71, and a cam roller shaft 75*a* is fixed to the cam mounting plate 75. The cam roller 74 is rotatably fitted to the cam roller shaft 75*a*, and the cam roller 74 engages the spiral groove 72*a* of the elevator shaft 72. When the elevator shaft 72 rotates, the cam roller 74 slides along the spiral groove 72*a*. The second Y-carriage seat 71 having the cam mounting plate 75 to which the cam roller 74 is fitted thereby moves up and down.

As illustrated in FIGS. 12A and 12B, the elevator shaft 72 has a drive gear 76 attached to the bottom end. External power is provided to rotate the elevator shaft 72. In addition, a stopper 77 to engage the drive gear 76 is provided to prevent the elevator shaft 72 from rotating due to the load of the second Y-carriage seat 71 when the drive gear 76 is not connected to the external power. The stopper 77 that has a hook 77*a* and a disengagement tab 77*b* is rotatably supported by a stopper shaft bearing 26 of the second X-carriage guide 23. An urging spring 78 connecting between the stopper 77 and a spring hook 27 urges the hook 77*a* of the stopper 77 in the direction in which the hook 77*a* engages the drive gear 76. A disengagement-tab-abutting member 28 is disposed at the base plate 11 so as to stand in the course of movement of the stopper 77.

Figure 14:
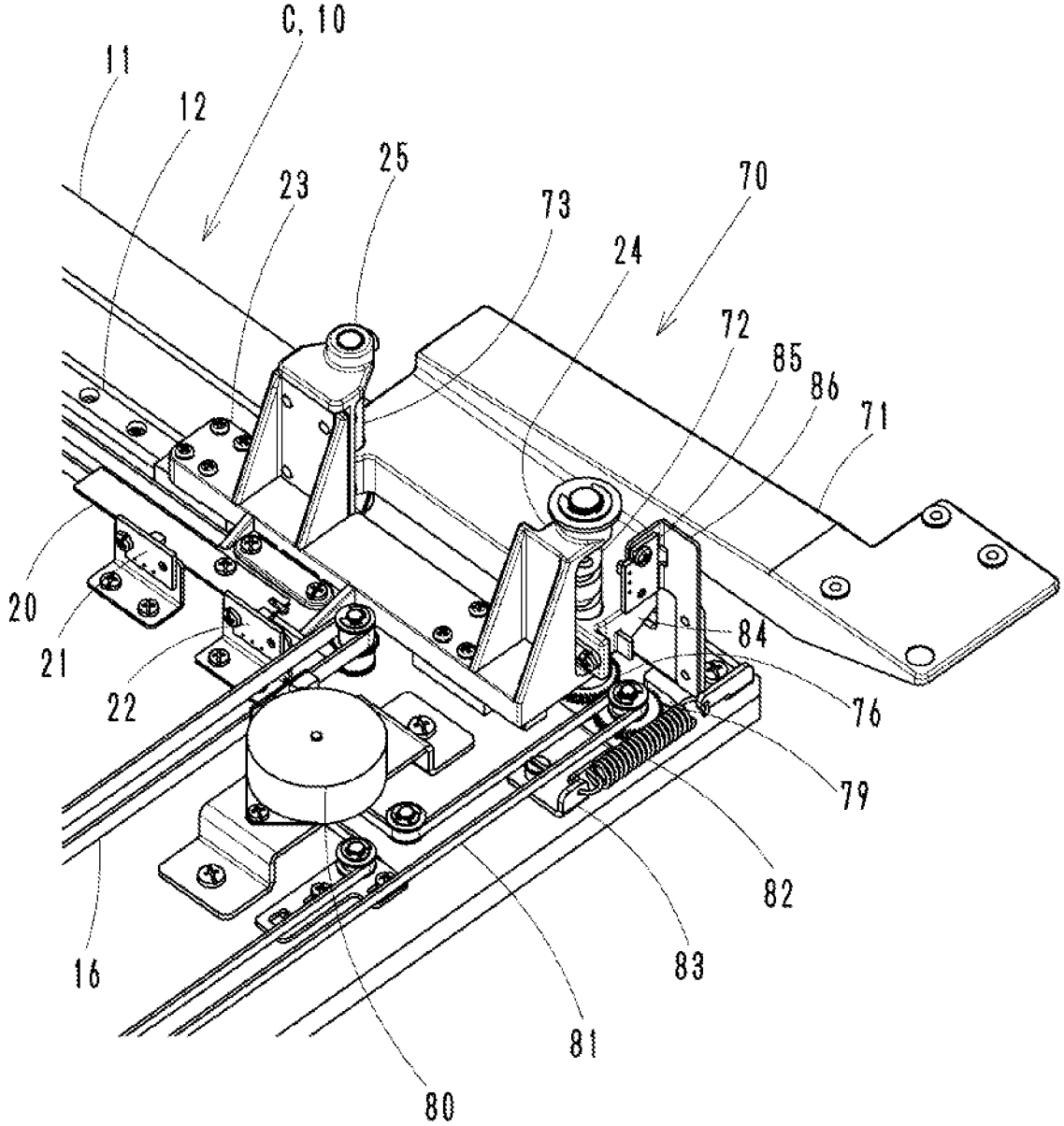
FIG. 14 is a perspective view illustrating a state in which the elevator mechanism of the embroidery apparatus of the second example is lowered.

As illustrated in FIG. 14, when the second X-carriage guide 23 is moved to the storage position, the drive gear 76 engages an elevator gear 79 to rotate the elevator shaft 72. A second elevator motor 80 rotates the elevator gear 79 using an elevator driving belt 81. The elevator gear 79 is mounted on a swing plate 83 that is urged by a swing spring 82 in the direction in which the elevator gear 79 engages the drive gear 76. This arrangement is provided to prevent gear teeth from breaking when the drive gear 76 and the elevator gear 79 engage each other. Note that as illustrated in FIG. 15, the elevator shafts 72 and members for driving the elevator shafts 72, such as the elevator gears 79, the swing springs 82, and the swing plates 83 are provided generally symmetrically in respective front and rear portions of the base plate 11.

An elevator sensor screen 84 is attached to a second Y-carriage seat 71. An elevator sensor 85 for detecting an upper position is attached to a sensor mounting plate 86 disposed so as to stand at the base plate 11 along the course of movement of the elevator sensor screen 84. The elevator sensor 85 serves as the reference position when the second Y-carriage seat 71 reaches the upper position and the cam roller 74 reaches the horizontal groove at the upper dead end of the spiral groove 72*a*.

Next, operation and advantageous effects of the present example will be described. During embroidery stitching, the carriage unit D of the embroidery apparatus Ba is held by the elevator mechanism 70 over the main unit C. The hook 77*a* of the stopper 77 urged by the urging spring 78 engages each drive gear 76, which prevents the elevator shaft 72 from rotating unexpectedly and thereby prevents the carriage unit D from descending. When the embroidery stitching is completed, the carriage unit D automatically returns to the home position illustrated in FIG. 11. The user detaches the embroidery frame from the embroidery frame holder 34 of the Y-direction translation mechanism 30. Subsequently, when the user touches a switching button for switching to the standard stitching, which is displayed at the display 6 of the sewing machine body A, the control device in the sewing machine body A issues the storage instruction to the embroidery apparatus Ba upon receiving the request of switching to the standard stitching from the switching button, as is the case for the first example.

Upon receiving the storage instruction, the embroidery apparatus Ba starts the Y-drive motor 35 of the Y-direction translation mechanism 30, which causes the Y-carriage guide 33 having the embroidery frame holder 34 to move rearward. The Y-sensor screen 40 attached to the Y-carriage guide 33 subsequently masks the second Y-sensor 42 for detecting the storage position. As a result, the I-drive motor 35 stops moving the Y-carriage guide 33 rearward, and the Y-direction translation mechanism 30 holds the embroidery frame holder 34 at the storage position outside the main unit C.

Simultaneously, the embroidery apparatus Ba starts the X-drive motor 14 of the X-direction translation mechanism 10, which moves the second X-carriage guides 23 leftward. The X-sensor screen 20 attached to the corresponding second X-carriage guide 23 subsequently masks the second X-sensor 22 for detecting the storage position. As a result, the X-drive motor 14 stops moving the second X-carriage guides 23 leftward, and the X-direction translation mechanism 10 and the elevator mechanism 70 holds the Y-direction translation mechanism 30 at the storage position outside the main unit C.

When the embroidery apparatus Ba causes the X-direction translation mechanism 10 to move the carriage unit D to the storage position, the drive gear 76 of each elevator shaft 72 of the elevator mechanism 70 engages the corresponding elevator gear 79. Simultaneously, the disengagement tab 77*b* of each stopper 77 abuts the corresponding disengagement-tab-abutting member 28 disposed on the base plate 11, which enables the elevator gear 79 to rotate.

The embroidery apparatus Ba issues the first storage-ready notification when the Y-sensor screen 40 attached to the Y-carriage guide 33 of the Y-direction translation mechanism 30 masks the second Y-sensor 42 for detecting the storage position. The embroidery apparatus B issues the second storage-ready notification when the second X-sensor 22 for detecting the storage position of the second X-carriage guides 23 of the X-direction translation mechanism 10 is masked.

Upon receiving the first storage-ready notification and the second storage-ready notification, the elevator mechanism 70 starts the second elevator motor 80 to rotate each elevator gear 79 using the elevator driving belt 81. Each elevator gear 79 engages the drive gear 76 and rotates the corresponding elevator shaft 72, which causes the each second Y-carriage seat 71 to descend. Rotation of each elevator shaft 72 lowers the cam roller 74 that engages the spiral groove 72*a* of the elevator shaft 72, which causes the corresponding second Y-carriage seat 71 to descend together with the cam roller 74.

When the second Y-carriage seats 71 descend, the number of rotation of each elevator shaft 72 is counted to the lower position from the upper position that has been detected by the elevator sensor 85 for detecting the upper position. The number counted is compared with a predetermined number of rotation of the elevator shaft 72. When the number counted reaches the predetermined number, the second elevator motor 80 stops rotating the elevator gear 79. Each second Y-carriage seat 71 reaches the lower position, and the cam roller 74 reaches the horizontal groove formed at the lower dead end of the spiral groove 72*a*. Consequently, the upper surface of the carriage unit D becomes flush with the upper surface of the body cover of the main unit C, as illustrated in FIG. 9C.

The operation for switching to the embroidery stitching after the standard stitching is completed is the same as that described in the first example, and detailed description will be omitted. In short, the elevator mechanism 70 raises the carriage unit D to the upper position, and subsequently the X-direction translation mechanism 10 and the Y-direction translation mechanism 30 move the carriage unit D to the home position. In the present example, the elevator mechanism 70 includes the stopper 77 to engage the drive gear 76 of each elevator shaft 72, which prevents the elevator shaft 72 from rotating unexpectedly. In addition, the grooves at the upper and lower dead ends of the spiral groove 72*a* of each elevator shaft 72 are formed horizontally. This prevents the carriage unit D from descending due to its own load when the drive gear 76 of the elevator shaft 72 is not connected to the external power.

As described above, the embroidery apparatus Ba of the present example is able to execute the switching operation automatically from the embroidery stitching to the standard stitching and also from the standard stitching to the embroidery stitching. In addition, in the embroidery apparatus Ba, the carriage unit D is raised and lowered by the rotation of the elevator shafts 72 of the elevator mechanism 70 at the sides of the main unit C. This enables the upper surface of the main unit C and the upper surface of the carriage unit D to be used as the auxiliary table during the standard stitching.

The embroidery apparatus of the present invention is advantageous. The embroidery apparatus can be applied to sewing machines capable of both embroidery and standard stitching. When the stitching mode is switched from embroidery stitching to standard stitching, the first translation mechanism is automatically evacuated from the upper surface of the main unit and stored at a position outside the main unit. Subsequently, the upper surface of the first translation mechanism is positioned so as to be flush with the upper surface of the main unit, which enables both the upper surface of the first translation mechanism and the upper surface of the main unit to be used as the auxiliary table.

What is claimed is:

1. An embroidery apparatus, comprising:

a main unit to be detachably mounted on a bed section of a sewing machine;

a first translation mechanism that moves an embroidery frame holder with an embroidery frame mounted thereon in a first direction, the embroidery frame extending horizontally;

a second translation mechanism that moves the first translation mechanism along an upper surface of the main unit in a second direction that orthogonally intersects the first direction; and an elevator mechanism that is supported by the second translation mechanism at opposite sides of the main unit and that raises and lowers the first translation mechanism while the embroidery frame is maintained to extend horizontally.

2. An embroidery apparatus, comprising:

a main unit to be detachably mounted on a bed section of a sewing machine;

a first translation mechanism that moves an embroidery frame holder with an embroidery frame mounted thereon in a first direction;

a second translation mechanism that moves the first translation mechanism along an upper surface of the main unit in a second direction that orthogonally intersects the first direction; and an elevator mechanism that is supported by the second translation mechanism at opposite sides of the main unit and that raises and lowers the first translation mechanism, wherein the elevator mechanism includes a pair of hinge arms that are swingably supported by the second translation mechanism, and wherein the hinge arms are swingable so as to move closer to each other and away from each other, and the swing movement of the hinge arms raises and lowers the first translation mechanism horizontally.

3. The embroidery apparatus according to claim 2, wherein the first translation mechanism has an elevator driving shaft that rotates with a rotation axis extending in the first direction, and a pair of first support seats that move in the first direction due to rotation of the elevator driving shaft, and each of the hinge arms has a first end portion pivotally supported by the second translation mechanism using a fulcrum shaft, and a second end portion pivotally connected to a corresponding one of the first support seats.

4. The embroidery apparatus according to claim 1, wherein the elevator mechanism has an elevator shaft that is rotatably supported by the second translation mechanism and configured to rotate forward and backward and thereby raise and lower the first translation mechanism.

5. The embroidery apparatus according to claim 4, wherein the elevator mechanism has a drive unit that is disposed at the second translation mechanism and that rotates the elevator shaft, and a second support seat that supports the first translation mechanism using the elevator shaft so as to be able to raise and lower the first translation mechanism.

6. An embroidery apparatus, comprising:

a main unit to be detachably mounted on a bed section of a sewing machine;

a first translation mechanism that moves an embroidery frame holder with an embroidery frame mounted thereon in a first direction;

a second translation mechanism that moves the first translation mechanism along an upper surface of the main unit in a second direction that orthogonally intersects the first direction; and an elevator mechanism that is supported by the second translation mechanism at opposite sides of the main unit and that raises and lowers the first translation mechanism, wherein upon receiving a storage instruction, the first translation mechanism moves the embroidery frame holder to an end of the first translation mechanism and issues a first storage-ready notification, and the second translation mechanism moves the first translation mechanism in the second direction to a position outside the main unit and issues a second storage-ready notification, and wherein upon receiving the first storage-ready notification and the second storage-ready notification, the elevator mechanism lowers the first translation mechanism until an upper surface of the first translation mechanism is flush with the upper surface of the main unit.

7. The embroidery apparatus according to claim 2, wherein, upon receiving a storage instruction, the first translation mechanism moves the embroidery frame holder to an end of the first translation mechanism and issues a first storage-ready notification, and the second translation mechanism moves the first translation mechanism in the second direction to a position outside the main unit and issues a second storage-ready notification, and upon receiving the first storage-ready notification and the second storage-ready notification, the elevator mechanism lowers the first translation mechanism until an upper surface of the first translation mechanism is flush with the upper surface of the main unit.

8. The embroidery apparatus according to claim 3, wherein, upon receiving a storage instruction, the first translation mechanism moves the embroidery frame holder to an end of the first translation mechanism and issues a first storage-ready notification, and the second translation mechanism moves the first translation mechanism in the second direction to a position outside the main unit and issues a second storage-ready notification, and upon receiving the first storage-ready notification and the second storage-ready notification, the elevator mechanism lowers the first translation mechanism until an upper surface of the first translation mechanism is flush with the upper surface of the main unit.

9. The embroidery apparatus according to claim 4, wherein, upon receiving a storage instruction, the first translation mechanism moves the embroidery frame holder to an end of the first translation mechanism and issues a first storage-ready notification, and the second translation mechanism moves the first translation mechanism in the second direction to a position outside the main unit and issues a second storage-ready notification, and upon receiving the first storage-ready notification and the second storage-ready notification, the elevator mechanism lowers the first translation mechanism until an upper surface of the first translation mechanism is flush with the upper surface of the main unit.

10. The embroidery apparatus according to claim 5, wherein, upon receiving a storage instruction, the first translation mechanism moves the embroidery frame holder to an end of the first translation mechanism and issues a first storage-ready notification, and the second translation mechanism moves the first translation mechanism in the second direction to a position outside the main unit and issues a second storage-ready notification, and upon receiving the first storage-ready notification and the second storage-ready notification, the elevator mechanism lowers the first translation mechanism until an upper surface of the first translation mechanism is flush with the upper surface of the main unit.

* * * * *